US011767765B2

(12) United States Patent
Devangada et al.

(10) Patent No.: US 11,767,765 B2
(45) Date of Patent: Sep. 26, 2023

(54) GLASS VISCOUS DAMPER

(71) Applicant: General Electric Company, Schenectady, NY (US)

(72) Inventors: Siddaraja Mallikarjuna Devangada, Bangalore (IN); John M. Delvaux, Fountain Inn, SC (US); Robert Frank Hoskin, Lawrenceville, GA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/670,591

(22) Filed: Feb. 14, 2022

(65) Prior Publication Data

US 2023/0100869 A1 Mar. 30, 2023

(30) Foreign Application Priority Data

Sep. 28, 2021 (IN) ..... 202111043986

(51) Int. Cl.

| | |
|---|---|
| ***F01D 5/18*** | (2006.01) |
| ***F01D 5/16*** | (2006.01) |
| ***F01D 5/30*** | (2006.01) |

(52) U.S. Cl.

CPC ..... *F01D 5/16* (2013.01); *F01D 5/18* (2013.01); *F01D 5/3007* (2013.01); (Continued)

(58) Field of Classification Search

CPC . F01D 5/16; F01D 5/18; F01D 5/3007; F05D 2220/32; F05D 2230/00; F05D 2260/96

See application file for complete search history.

(56) References Cited

U.S. PATENT DOCUMENTS 5,820,348 A * 10/1998 Fricke ..... F16F 15/10 416/500

7,347,664 B2 3/2008 Kayser et al.

(Continued)

FOREIGN PATENT DOCUMENTS

EP 2568117 A1 3/2013

FR 2819295 A1 * 7/2002 ..... F01D 5/147

(Continued)

OTHER PUBLICATIONS

Brow, Physical Properties of Glass, Web Course, Missouri University of Science & Technology FS08, 63 Pages. Retrieved Aug. 25, 2021 from Web Page: https://www.lehigh.edu/imi/teched/GlassProp/Slides/GlassProp_Lecture5_Brow_Part1.pdf.

(Continued)

*Primary Examiner* — David E Sosnowski

*Assistant Examiner* — Theodore C Ribadeneyra

(74) *Attorney, Agent, or Firm* — Dority & Manning, P.A.

(57) ABSTRACT

Rotor blades, vibrational dampening elements, and methods are provided. A rotor blade includes a platform, a shank extending radially inward from the platform, and an airfoil extending radially outward from the platform. One or more fluid chambers are defined within the rotor blade. Glass is disposed within each fluid chamber of the one or more fluid chambers. A mass is disposed within each fluid chamber of the one or more fluid chambers. The mass is movable within the glass relative to the airfoil.

18 Claims, 16 Drawing Sheets

(52) U.S. Cl.
CPC ..... *F05D 2220/32* (2013.01); *F05D 2230/00* (2013.01); *F05D 2260/96* (2013.01)

(56) References Cited

U.S. PATENT DOCUMENTS

| | | | | |
|---|---|---|---|---|
| 9,121,288 | B2 | 9/2015 | Campbell et al. | |
| 9,334,740 | B2 | 5/2016 | Kellerer et al. | |
| 9,382,962 | B2 | 7/2016 | Scarpa et al. | |
| 9,879,551 | B2 | 1/2018 | Blaney et al. | |
| 10,557,353 | B2 | 2/2020 | Malmborg et al. | |
| 10,808,794 | B1 * | 10/2020 | Boyce | F16F 15/02 |
| 2002/0090302 | A1 * | 7/2002 | Norris | F01D 5/16 416/232 |
| 2004/0018091 | A1 * | 1/2004 | Rongong | F04D 29/324 416/232 |
| 2005/0249601 | A1 * | 11/2005 | Burdgick | F01D 5/282 416/229 A |
| 2006/0029501 | A1 * | 2/2006 | Burdgick | F01D 5/147 416/224 |
| 2008/0025845 | A1 * | 1/2008 | Clark | F01D 5/16 416/223 A |
| 2009/0053068 | A1 * | 2/2009 | Hardwicke | F01D 5/16 416/241 B |
| 2009/0056126 | A1 * | 3/2009 | Chivers | F01D 5/16 29/889.2 |
| 2010/0028133 | A1 * | 2/2010 | Delvaux | F01D 25/06 415/119 |
| 2010/0143097 | A1 * | 6/2010 | Read | F01D 5/282 415/119 |
| 2011/0070095 | A1 * | 3/2011 | Harron | F01D 5/16 416/96 R |
| 2013/0058785 | A1 * | 3/2013 | Kellerer | F16F 15/363 416/1 |
| 2013/0195652 | A1 * | 8/2013 | Pope | F04D 29/544 416/223 R |
| 2013/0294891 | A1 * | 11/2013 | Neuhaeusler | F01D 5/147 29/889.7 |
| 2019/0218914 | A1 * | 7/2019 | Hansen | F01D 5/147 |
| 2020/0123904 | A1 * | 4/2020 | Clark | F04D 29/668 |

FOREIGN PATENT DOCUMENTS

| | | | | |
|---|---|---|---|---|
| GB | 2529641 | A * | 3/2016 | F01D 5/147 |
| JP | 6278448 | B2 | 2/2018 | |
| WO | WO02/084114 | A1 | 10/2002 | |

OTHER PUBLICATIONS

Hu, Mit 3.071 Amorphous Materials, Lecture 5: Viscosity of Glass, 22 Pages. Retrieved Aug. 25, 2021 from Web Page: https://ocw.mit.edu/courses/materials-science-and-engineering/3-071-amorphous-materials-fall-2015/lecture-notes/MIT3_071F15_Lecture5.pdf.

Varshneya, Industrial Glass, Encyclopedia Britannica, May 10, 2016, 46 Pages. https://www.britannica.com/topic/glass-properties-composition-and-industrial-production-234890. Accessed Aug. 25, 2021. https://www.britannica.com/topic/glass-properties-composition-and-industrial-production-234890/Properties-of-glass.

* cited by examiner

GLASS VISCOUS DAMPER

PRIORITY STATEMENT

The present application claims priority to Indian Patent Application Serial No. 202111043986, filed Sep. 28, 2021, which is incorporated by reference herein in its entirety.

FIELD

The present disclosure relates generally to a viscous damper configured to adjust the amplitude of oscillations of a component. Specifically, the present disclosure relates generally to a viscous damper for a turbomachine component that utilizes glass as the viscous fluid.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

Typically, turbomachine rotor blades are exposed to unsteady aerodynamic loading which causes the rotor blades to vibrate. If these vibrations are not adequately damped, they may cause high cycle fatigue and premature failure in the blades. Of all the turbine stages, the last-stage blade (LSB) is the tallest and therefore is the most vibrationally challenged component of the turbine. Conventional vibration damping methods for turbine blades include platform dampers, damping wires, shrouds, and the like.

Platform dampers sit underneath the surface of the blade platform and are effective for medium and long shank blades, which experience motion at the blade platform. Aft-stage blades have short shanks to reduce the weight of the blade and in turn reduce the pull load on the rotor, which renders platform dampers ineffective.

Generally, turbomachine rotor blades get their damping primarily from the shrouds. Shrouds can be located at the blade tip (tip shroud) or at a partial span between the hub and tip (part-span shroud). These shrouds contact against adjacent blades and provide damping when they rub against each other.

While shrouds provide damping and stiffness to the airfoil, they make the blade heavier, which in turn increases the pull load on the rotor and increases the weight and cost of the rotor. Thus, light-weight solutions for aft-stage blades are attractive to drive overall power output of the turbomachine. Generally, shrouds can create aerodynamic performance losses. For example, tip shrouds need a large tip fillet to reduce stress concentrations which creates tip losses, and part-span shrouds create an additional blockage in the flow path and reduce aerodynamic efficiency. Lastly, it has been shown that tip shrouds induce significant twist in the vibration mode shapes of the blade causing high aeroelastic flutter instability.

Viscous dampers may be employed for reducing the vibrations in a turbomachine component. However, known viscous dampers often include fluids that are reactive with metals, such that the viscous dampers have limited hardware life due to erosion of the metal casings. Accordingly, a viscous damper that reduces blockages in the flow path (e.g., by eliminating one or more shrouds), without reacting with the viscous damper casing, is desired and would be appreciated in the art.

BRIEF DESCRIPTION

Aspects and advantages of the rotor blades, vibrational dampening elements, and methods in accordance with the present disclosure will be set forth in part in the following description, or may be obvious from the description, or may be learned through practice of the technology.

In accordance with one embodiment, a rotor blade is provided. The rotor blade includes a platform, a shank extending radially inward from the platform, and an airfoil extending radially outward from the platform. One or more fluid chambers are defined within the rotor blade. Glass is disposed within each fluid chamber of the one or more fluid chambers. A mass is disposed within each fluid chamber of the one or more fluid chambers. The mass is movable within the glass relative to the airfoil.

In accordance with another embodiment, a vibrational dampening element is provided. The vibrational dampening element is attached to a turbine component and configured to adjust an amplitude of oscillations of the turbine component. The vibrational dampening element includes a mass and a casing encapsulating the mass. The casing of the vibrational dampening element defines a fluidic chamber around the mass, and the fluidic chamber is filled with glass.

In accordance with yet another embodiment, a method of adjusting an amplitude of oscillations of a turbine component disposed in a turbine section of a turbomachine is provided. The method includes providing the turbine component having a fluid chamber and a mass disposed within the fluid chamber. The method further includes disposing glass within the fluid chamber. Operation of the turbine results in a decrease of a viscosity of the glass to produce a molten-state glass, such that the mass is translated through the molten-state glass to adjust an amplitude of oscillations of the turbomachine component.

These and other features, aspects, and advantages of the present rotor blades, vibrational dampening elements, and methods will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present rotor blades, vibrational dampening elements, and methods, including the best mode of making and using the present systems and methods, directed to one of ordinary skill in the art, is set forth in the specification, which makes reference to the appended figures, in which.

DETAILED DESCRIPTION

Figure 1:
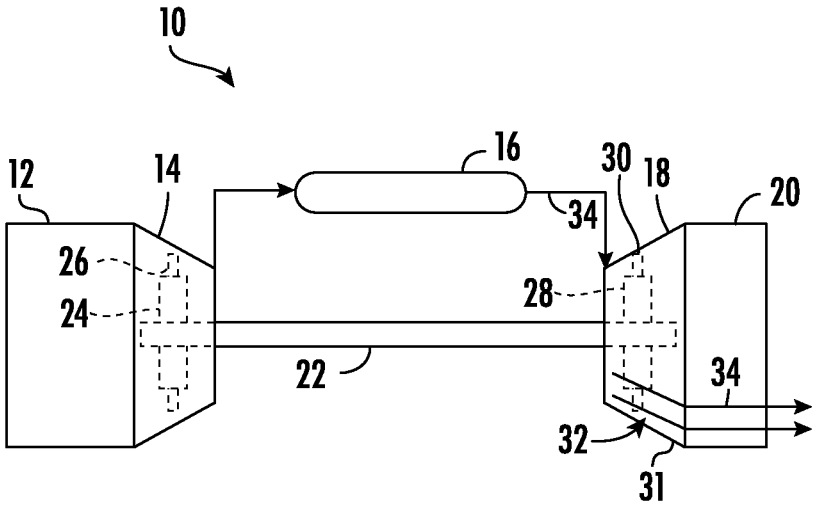
FIG. 1 illustrates a schematic illustration of a turbomachine in accordance with embodiments of the present disclosure.

Reference now will be made in detail to embodiments of the present rotor blades, vibrational dampening elements, and methods, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component. Terms of approximation, such as "generally," or "about," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to the drawings, FIG. 1 provides a schematic diagram of one embodiment of a turbomachine, which in the illustrated embodiment is a gas turbine 10. Although an industrial or land-based gas turbine is shown and described herein, the present disclosure is not limited to a land-based and/or industrial gas turbine, unless otherwise specified in the claims. For example, the rotor blades as described herein may be used in any type of turbomachine, including but not limited to a steam turbine, an aircraft gas turbine, or a marine gas turbine.

As shown, the gas turbine 10 generally includes an inlet section 12, a compressor section 14 disposed downstream of the inlet section 12, one or more combustors (not shown) within a combustor section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14. The rotor blades 26 are arranged in stages with corresponding arrays of stationary vanes (not shown) that are coupled to the compressor casing.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds a portion of the shaft 22 and the rotor blades 30, thereby at least partially defining a hot gas path 32 through the turbine section 18. The rotor blades 30 are arranged in stages with corresponding arrays of stationary vanes (100, as shown in FIG. 2) that are coupled to the turbine casing.

During operation, a working fluid such as air flows through the inlet section 12 and into the compressor section 14 where the air is progressively compressed through multiple stages of rotating blades 26 and stationary vanes, thus providing pressurized air to the combustors of the combustor section 16. The pressurized air is mixed with fuel and burned within one or more combustors to produce combustion gases 34. The combustion gases 34 flow through the hot gas path 32 from the combustor section 16 into the turbine section 18, where energy (kinetic and/or thermal) is transferred from the combustion gases 34 through multiple stages of the rotor blades 30 and stationary vanes, causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

Figure 2:
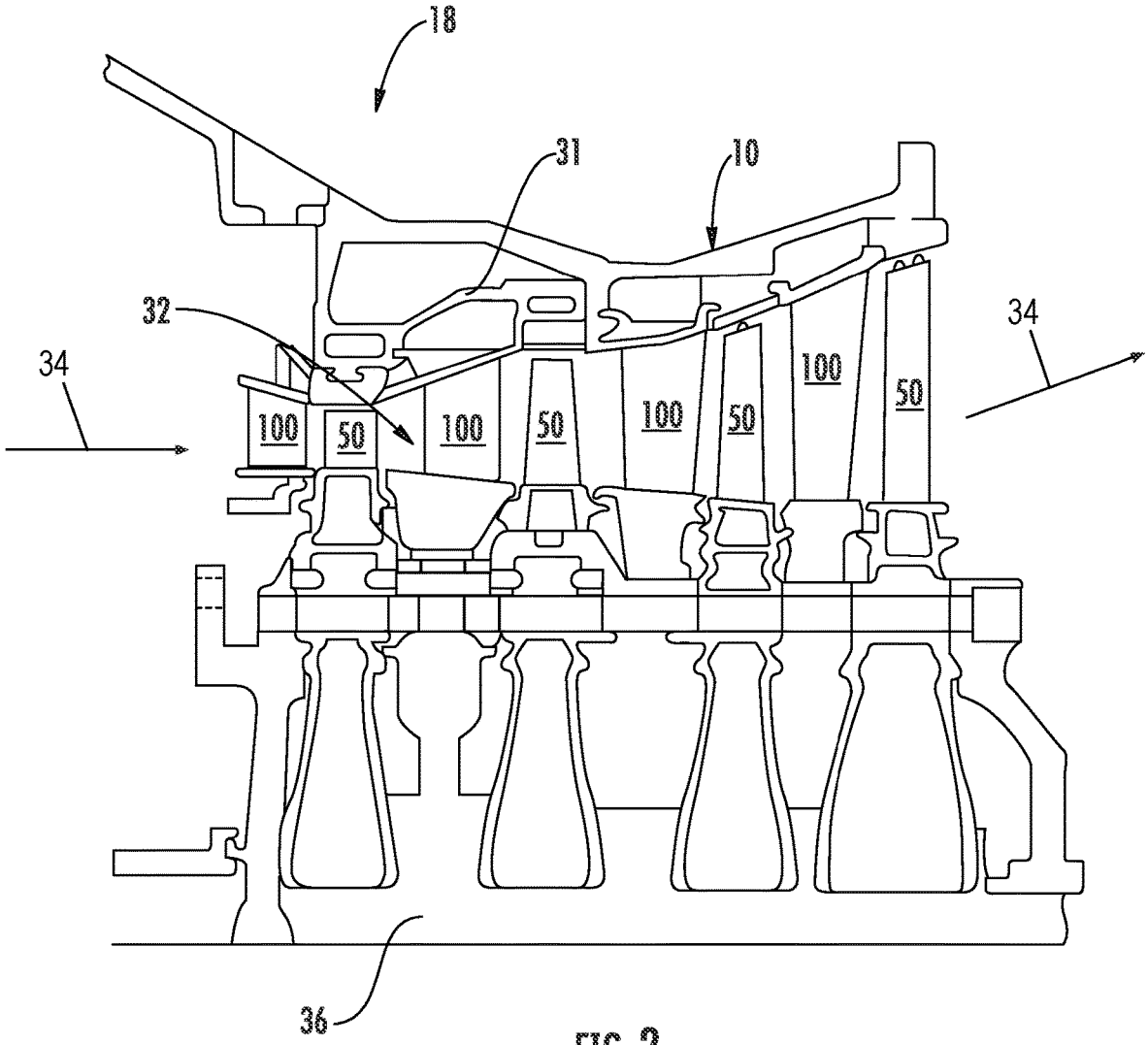
FIG. 2 illustrates an exemplary turbine section of a gas turbine including a plurality of turbine stages arranged in serial flow order, in accordance with embodiments of the present disclosure.

FIG. 2 illustrates an exemplary turbine section 18 of the gas turbine 10 including a plurality of turbine stages arranged in serial flow order. Each stage of the turbine includes a row of stationary turbine nozzles or vanes (e.g., nozzles 100) disposed axially adjacent to a corresponding rotating row of turbine rotor blades (e.g., blades 50). Four turbine stages are illustrated in FIG. 2. The exact number of stages of the turbine section 18 may be more or less than the four stages illustrated in FIG. 2. The four stages are merely exemplary of one turbine design and are not intended to limit the presently claimed turbine rotor blade in any manner.

Each stage comprises a plurality of turbine nozzles or vanes 100 and a plurality of turbine rotor blades 50. The turbine nozzles 100 are mounted to the outer casing 31 and are annularly arranged about an axis of a turbine shaft 22. The turbine rotor blades 50 are annularly arranged about the turbine shaft 22 and coupled to the turbine rotor 36.

It will be appreciated that the turbine nozzles 100 and turbine rotor blades 50 are disposed or at least partially disposed within the hot gas path 32 of the turbine section 18. The various stages of the turbine 10 at least partially define the hot gas path 32 through which combustion gases 34, as indicated by arrows, flow during operation of the gas turbine 10.

Figure 3:
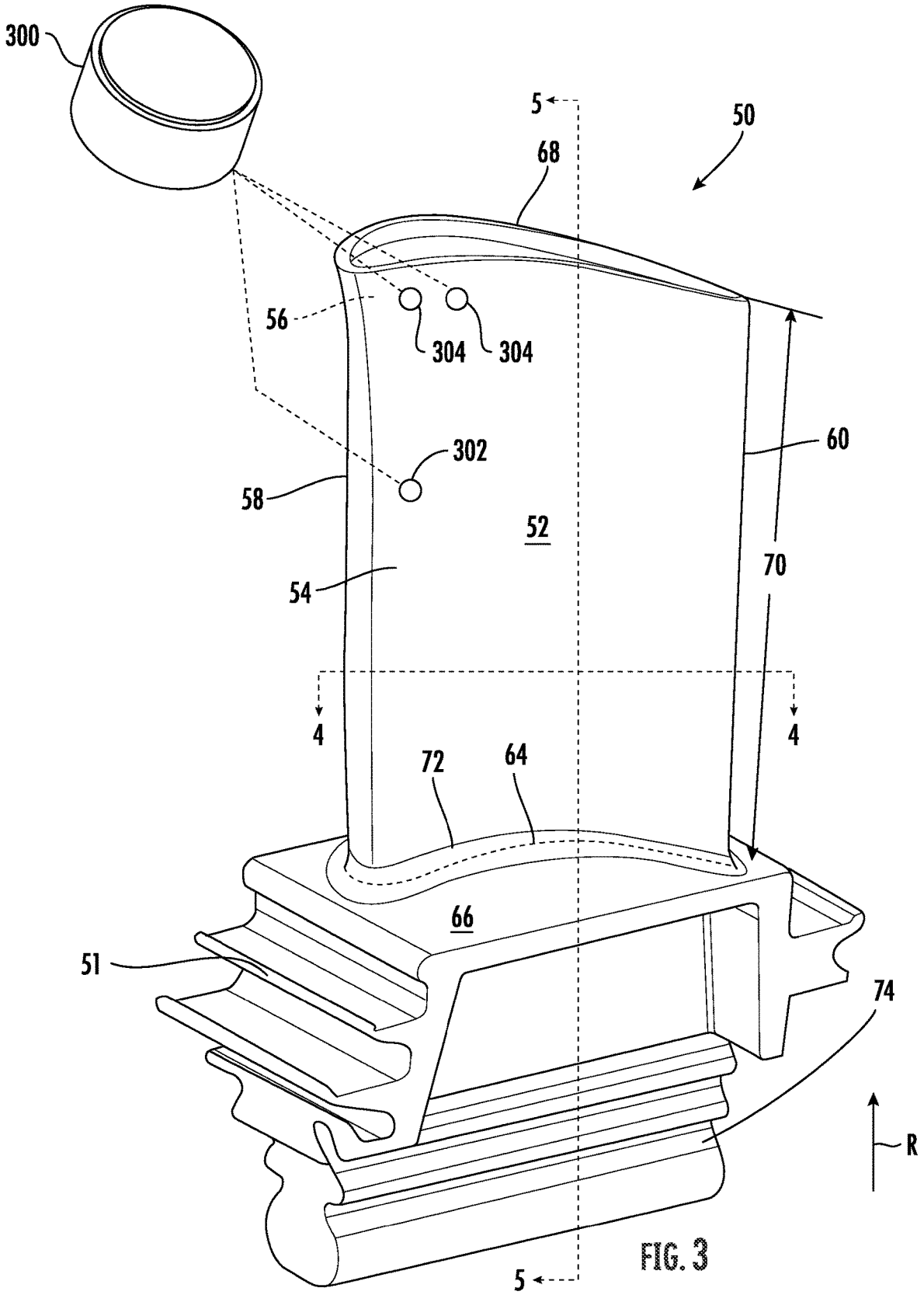
FIG. 3 illustrates a perspective view of a rotor blade, in accordance with embodiments of the present disclosure.

FIG. 3 provides a perspective view of a rotor blade 50 as may be incorporated in any stage of the turbine section 18 or the compressor section 14. In exemplary embodiments, the rotor blade 50 may be configured for use within the turbine section 18. As shown in FIG. 3, the turbine rotor blade 50 includes a platform 66, a shank 51, and an airfoil 52. As shown, the shank 51 may extend radially inward from the platform 66 with respect to the axial centerline of the gas turbine 10. In many embodiments, the airfoil 52 may extend from the platform 66 opposite the shank 51. For example, the airfoil 52 may extend radially outward from the platform with respect to the axial centerline of the gas turbine 10. In various embodiments, the airfoil 52 includes a pressure side wall 54 and an opposing suction side wall 56. The pressure side wall 54 and the suction side wall 56 meet or intersect at a leading edge 58 and a trailing edge 60 of the airfoil 52. The leading edge 58 and the trailing edge 60 may be spaced apart from one another and define the terminal ends of the airfoil 52 in the axial direction A. A straight chord line (not shown) extends between the leading edge 58 and the trailing edge 60 such that pressure and suction side walls 54, 56 extend in chord or chordwise between the leading edge 58 and the trailing edge 60.

The pressure side wall 54 generally comprises an aerodynamic, concave external surface of the airfoil 52. Similarly, the suction side wall 56 may generally define an aerodynamic, convex external surface of the airfoil 52. The leading edge 58 of airfoil 52 may be the first portion of the airfoil 52 to engage, i.e., be exposed to, the combustion gases 34 along the hot gas path 32. The combustion gases 34 may be guided along the aerodynamic contour of airfoil 52, i.e., along the suction side wall 56 and pressure side wall 54, before being exhausted at the trailing edge 60.

As shown in FIG. 3, the airfoil 52 includes a root or first end 64, which intersects with and extends radially outwardly from the platform 66 of the turbine rotor blade 50. The root 64 of the airfoil 52 may be defined at an intersection between the airfoil 52 and the platform 66. The airfoil 52 terminates radially at a second end or tip 68 of the airfoil 52. The tip 68 is disposed radially opposite the root 64. As such, the tip 68 may generally define the radially outermost portion of the rotor blade 50 and, thus, may be configured to be positioned adjacent to a stationary shroud or seal (not shown) of the turbine section 18.

The pressure and suction side walls 54, 56 extend in span and define a span length 70 of the airfoil 52 between the root 64 and/or the platform 66 and the tip 68 of the airfoil 52. In other words, each rotor blade 50 includes an airfoil 52 having opposing pressure and suction side walls 54, 56 that extend in chord or chordwise between opposing leading and trailing edges 58, 60 and that extend in span or spanwise 70 between the root 64 and the tip 68 of the airfoil 52.

In particular configurations, the airfoil 52 may include a fillet 72 formed between the platform 66 and the airfoil 52 proximate to the root 64. The fillet 72 can include a weld or braze fillet, which can be formed via conventional MIG welding, TIG welding, brazing, etc., and can include a profile that can reduce fluid dynamic losses as a result of the presence of fillet 72. In particular embodiments, the platform 66, the airfoil 52, and the fillet 72 can be formed as a single component, such as by casting and/or machining and/or 3D printing and/or any other suitable technique now known or later developed and/or discovered. In particular configurations, the rotor blade 50 includes a mounting portion 74 (such as a dovetail joint), which is formed to connect and/or to secure the rotor blade 50 to the rotor disk 28 and/or the shaft 22.

The span length 70 may be measured from the root 64 to the tip 68 of the airfoil 52. A percentage of the span length 70 may be used to indicate a position along the span length 70. For example, "0% span" may refer to the root 64 of the airfoil 52. Similarly, "100% span" may refer the tip 68 of the airfoil.

Figure 4:
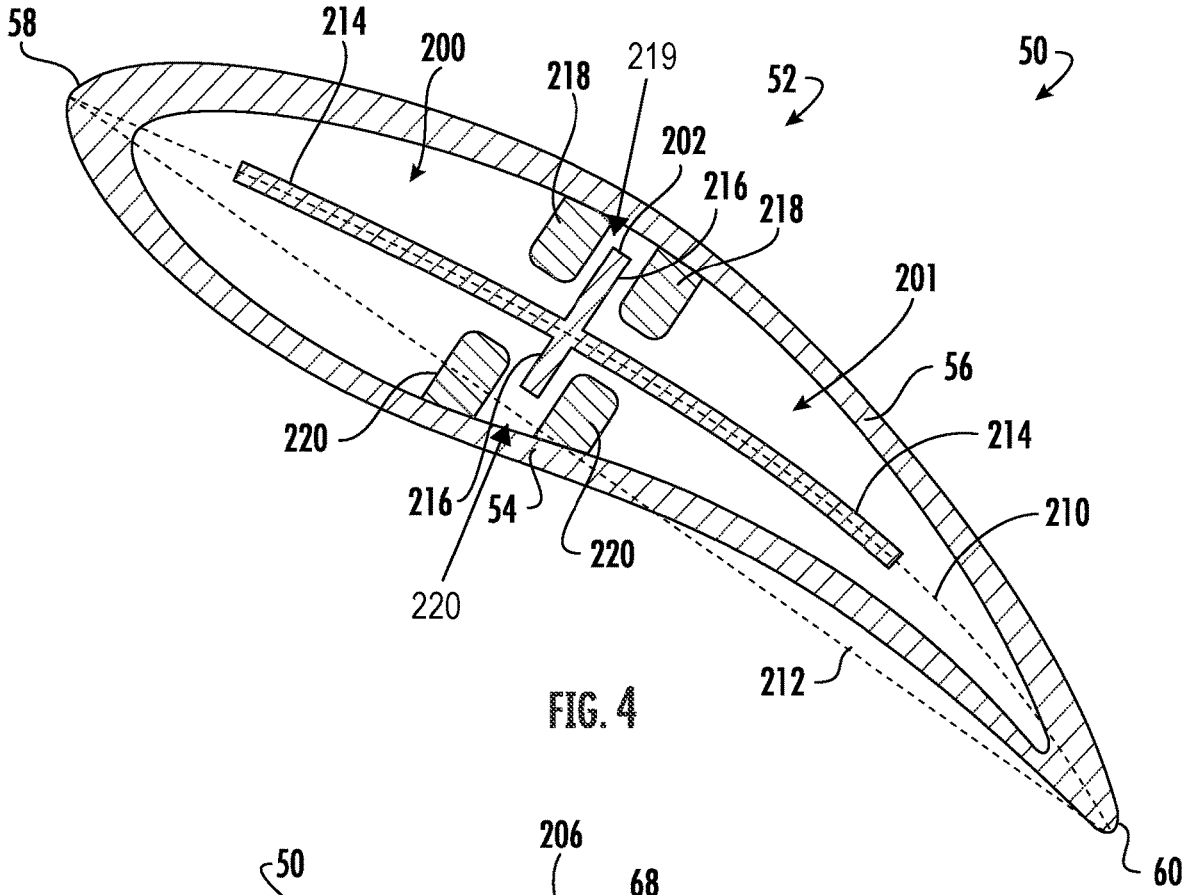
FIG. 4 illustrates a cross-sectional view of the rotor blade from along the line 4-4 shown in FIG. 3, in accordance with embodiments of the present disclosure.
Figure 5:
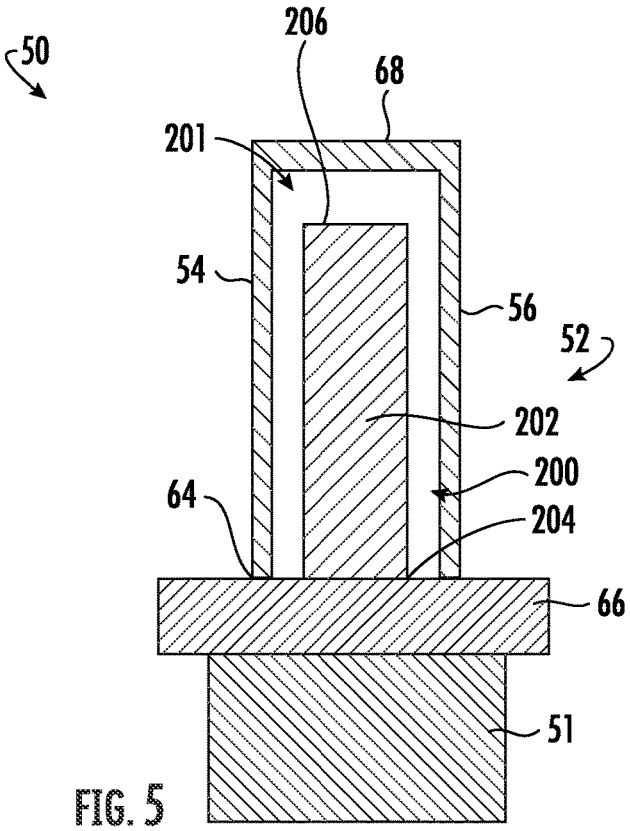
FIG. 5 illustrates a cross-sectional view of the rotor blade from along the line 5-5 shown in FIG. 3, in accordance with embodiments of the present disclosure.

FIG. 4 illustrates a cross-sectional view of the rotor blade 50 from along the line 4-4 shown in FIG. 3, and FIG. 5 illustrates a cross-sectional view of the rotor blade 50 from along the line 5-5 shown in FIG. 3, in accordance with embodiments of the present disclosure. As shown, a fluid chamber 200 may be defined within the airfoil 52, such that the airfoil 52 is a substantially hollow body. For example, as shown in FIG. 4, the fluid chamber 200 may be defined collectively by the leading edge 58, the trailing edge 60, the pressure side wall 54, and the suction side wall 56. In some embodiments, the fluid chamber 200 may extend radially between the root 64 and the tip 68 of the airfoil 52. In alternate embodiments (not shown), the fluid chamber 200 may extend radially over a portion of the span length 70 between the root 64 and the tip 68 of the airfoil 52.

In exemplary embodiments, glass 201 may fill the fluid chamber 200, such that a mass 202 is surrounded by glass 201 within the fluid chamber 200 (as shown by the white space surrounding the mass 202 in FIG. 4). For example, in exemplary embodiments, glass 201 may entirely fill the fluid chamber 200 (e.g., 100% of the space between the mass and the surrounding walls). However, in other embodiments, the glass 201 may only partially fill the fluid chamber 200, and the remainder may be filled with another fluid (such as air). The glass 201 may be in a solid state when the rotor blade 50 is non-operational, such that the mass 202 may be rigidly held or non-movable within the glass 201 when the rotor blade 50 is not at operating temperatures. Once the rotor blade 50 reaches operating temperatures, the viscosity of the glass 201 may decrease, and the glass 201 may soften or liquefy, such that the mass 202 may be movable within the glass 201 relative to the airfoil 52.

The mass 202 may be disposed within the fluid chamber 200. In many embodiments, where the mass 202 may be formed of metal or other suitable material, the use of glass 201 as the viscous damping fluid may be advantageous as the glass 201 will not react or erode the mass 202. The mass 202 may be movable within the glass 201 relative to the airfoil 52 at the operating temperatures of the turbine. For example, the mass 202 may be spaced apart from the interior surfaces of the airfoil 52, e.g., spaced apart from the leading edge 58, the trailing edge 60, the pressure side wall 54, and/or the suction side wall 56. In some embodiments, the mass 202 may be completely detached from the rotor blade 50, such that the mass 202 is entirely movable within the fluid chamber 200 during operation.

Figure 14:
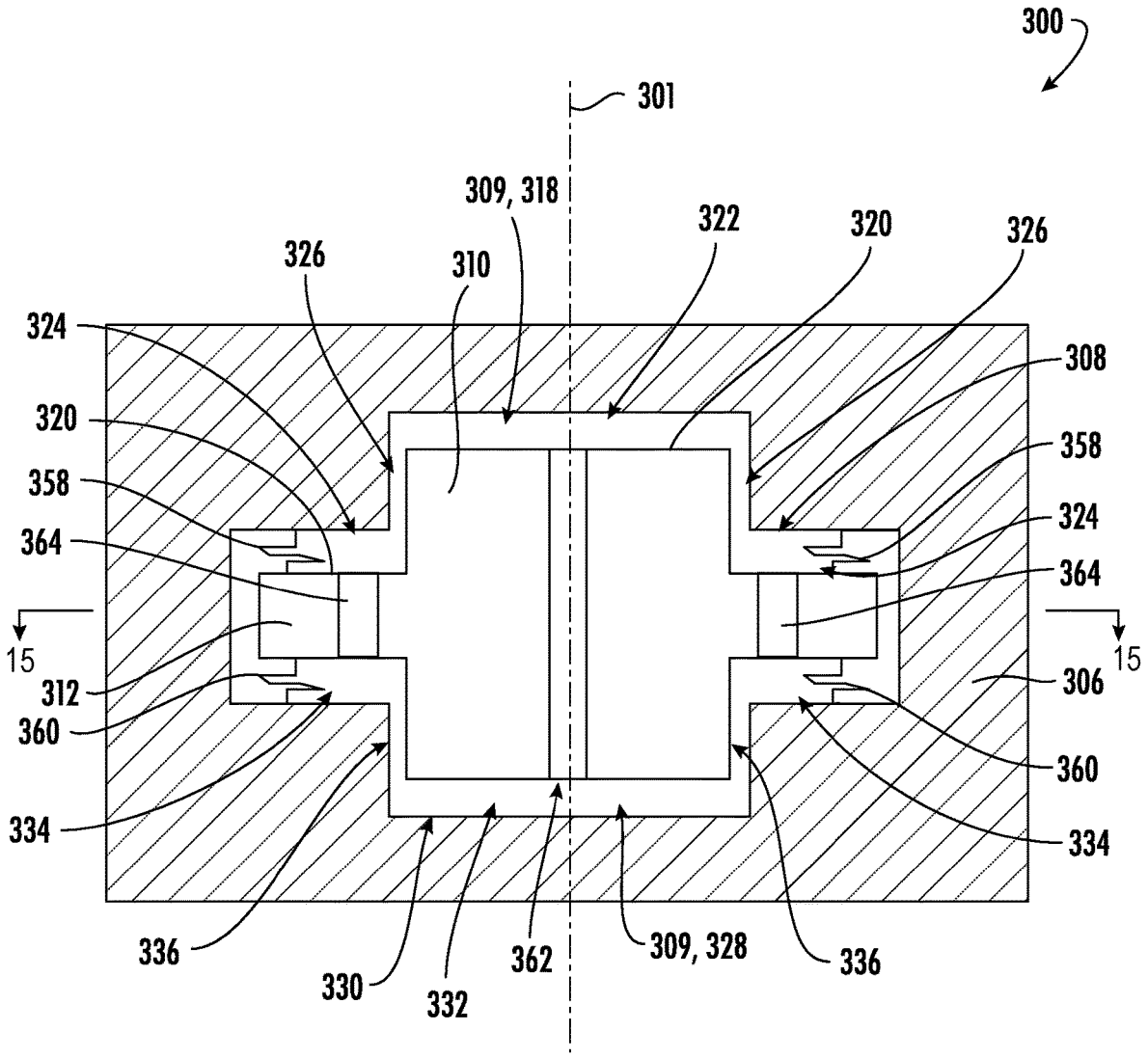
FIG. 14 illustrates a cross-sectional view of the vibrational dampening element shown in FIG. 13 from along a radial direction, in accordance with embodiments of the present disclosure.

In other embodiments, the mass 202 may be attached to the rotor blade 50 on one end, such that the mass 202 may be cantilevered within the fluid chamber 200. For example, as shown in FIG. 5, the mass 202 may extend between a first end 204 coupled to the rotor blade 50 (or platform 66) and a second end 206 disposed within the fluid chamber 200. In many embodiments, the first end 204 of the mass 202 may be attached to the root 64 of the airfoil 52 (such as an interior surface of the pressure or suction side walls 54, 56), attached to the platform 66, or attached to one of the pair of guides 218, 220. In yet still further embodiments, the mass 202 may be suspended within the fluid chamber 200 (and the glass 201) by one or more support members (such as a compliant support or bellows, as shown in FIG. 14).

In various embodiments, the mass 202 may have a variety of heights (e.g., the radial distance between the first end 204 and the second end 206). In some embodiments, as shown, the second end 206 may be closer to the tip 68 than the root 64 of the airfoil 52. In other embodiments (not shown), the second end 206 may be closer to the root 64 than the tip 68 of the airfoil 52.

As should be appreciated, the airfoil 52 may define a camber line 210 (FIG. 4) that extends between the leading edge 58 and the trailing edge 60. For example, the camber line 210 may join the leading and trailing edges 58, 60 of the airfoil 52 equidistant from the pressure side wall 54 and the suction side wall 56. Additionally, the airfoil 52 may define a chord line 212, which may is defined as a straight line between the leading edge 58 and the trailing edge 60.

In many embodiments, the mass 202 may include a first portion 214 and a second portion 216. In many embodiments, the first portion 214 may be longer than the second portion 216. The first portion 214 may be oriented generally parallel to the pressure side wall 54 and/or the suction side wall 56. Additionally, or alternatively, the first portion 214 may extend generally along the camber line 210 when in a resting position (e.g., when the rotor blade 50 is not in operation). The second portion 216 may extend generally perpendicularly to one or more of the first portion 214, the pressure side wall 54, the suction side wall 56, and/or the chord line 212. In many embodiments, the first portion 214 and the second portion 216 may extend generally perpendicularly to one another at their respective midpoints. For example, the first portion 214 may extend generally perpendicularly from the second portion 216 at the midpoint of the second portion 216. Likewise, the second portion 216 may extend generally perpendicularly from the first portion 214 at the midpoint of the first portion 214. In this way, the mass 202 may advantageously have a center of mass at the intersection of the first portion 214 and the second portion 216 that equalizes the force distribution when actively damping vibrations of the rotor blade 50.

In exemplary embodiments, a first pair of guides 218 may extend inwardly from the pressure side wall 54, and a second pair of guides 220 extend inwardly from the suction side wall 56. As illustrated, the first pair of guides 218 may be directly opposite the second pair of guides 220. As shown, a first channel 219 may be defined between the first pair of guides 218, and a second channel 221 may be defined between the second pair of guides 220. The second portion 216 of the mass 200 may extend into the first channel 219 and the second channel 221, such that the guides 218, 220 may partially restrict movement of the mass 202 along a camber-wise direction.

As shown in FIG. 5, the fluid chamber 200 may extend radially between the root 64 and the tip 68 of the airfoil 52. In some embodiments (not shown), the fluid chamber 200 may extend within the platform 66 and/or the shank 51, such that the fluid chamber 200 may be collectively defined by the airfoil 52, the platform 66, and/or the shank 51. In many embodiments, the mass 202 may be entirely detached from the rotor blade 50 and entirely surrounded by glass 201 within the fluid chamber 200. In such embodiments, the mass 202 may be unrestricted to movement within the glass 201 during operation (e.g., at operating temperatures of the gas turbine). In other embodiments, as shown in FIG. 5, the mass 202 may be attached to the rotor blade 50 on one or more ends. For example, the mass 202 may be cantilevered from the rotor blade 50 within the fluid chamber 200.

Figure 6:
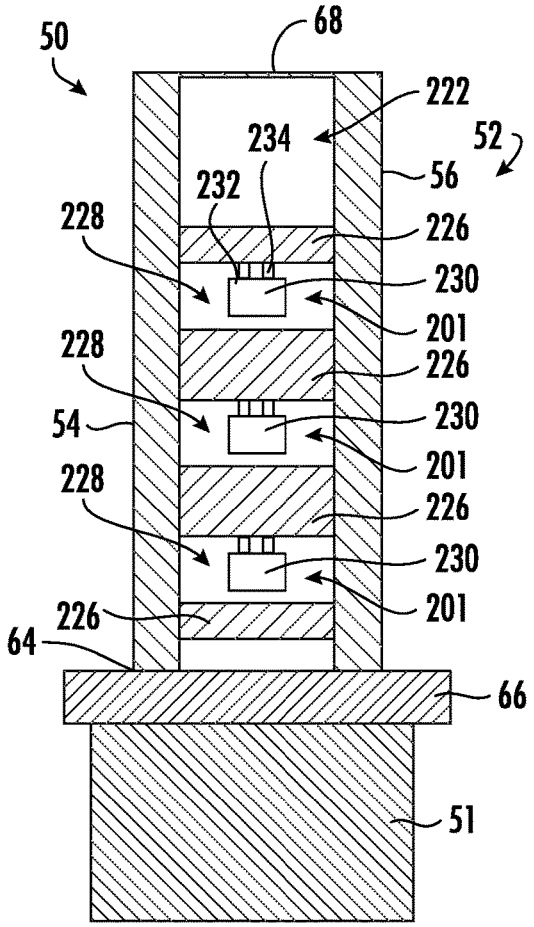
FIG. 6 illustrates a cross-sectional side view of a rotor blade, in accordance with embodiments of the present disclosure.
Figure 7:
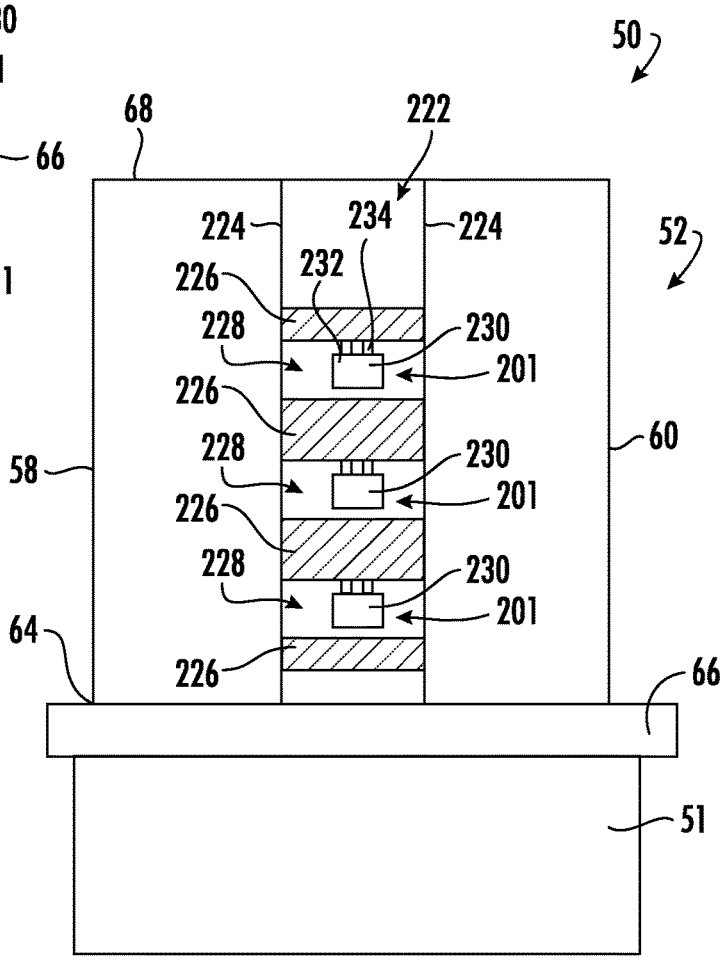
FIG. 7 illustrates a cross-sectional side view of a rotor blade, in accordance with embodiments of the present disclosure.

FIG. 6 and FIG. 7 illustrate different cross-sectional side views of an exemplary rotor blade 50, each in accordance with embodiments of the present disclosure. As shown, the airfoil 52 may define a radial channel 222 that extends within the airfoil 52 between the root 64 and the tip 68. For example, the radial channel 222 may be collectively defined (or bound) by the suction side wall 56, the pressure side wall 54, and one or more ribs 224 extending between the pressure side wall 54 and the suction side wall 56. In exemplary embodiments, separating walls 226 may partition or separate the radial channel 222 into one or more fluid chambers 228. A mass 230 may be disposed within each fluid chamber 228 of the one or more fluid chambers 228. The mass may include a main body 232 and one or more protrusions 234 extending from the main body 232. Additionally, glass 201 may fill each of the fluid chambers 228, such that each mass 230 is generally surrounded by glass 201. Each mass 230 may be fully movable within the glass 201 and in the respective fluid chamber 228 when the rotor blade 50 is at operating temperature. In some embodiments, the mass 230 may be entirely detached from the rotor blade 50. In other embodiments, the mass 230 may be attached to the rotor blade 50 on one end (e.g., via one or more of the protrusions 234), such that the mass 230 is cantilevered within the respective fluid chamber 228.

Figure 8:
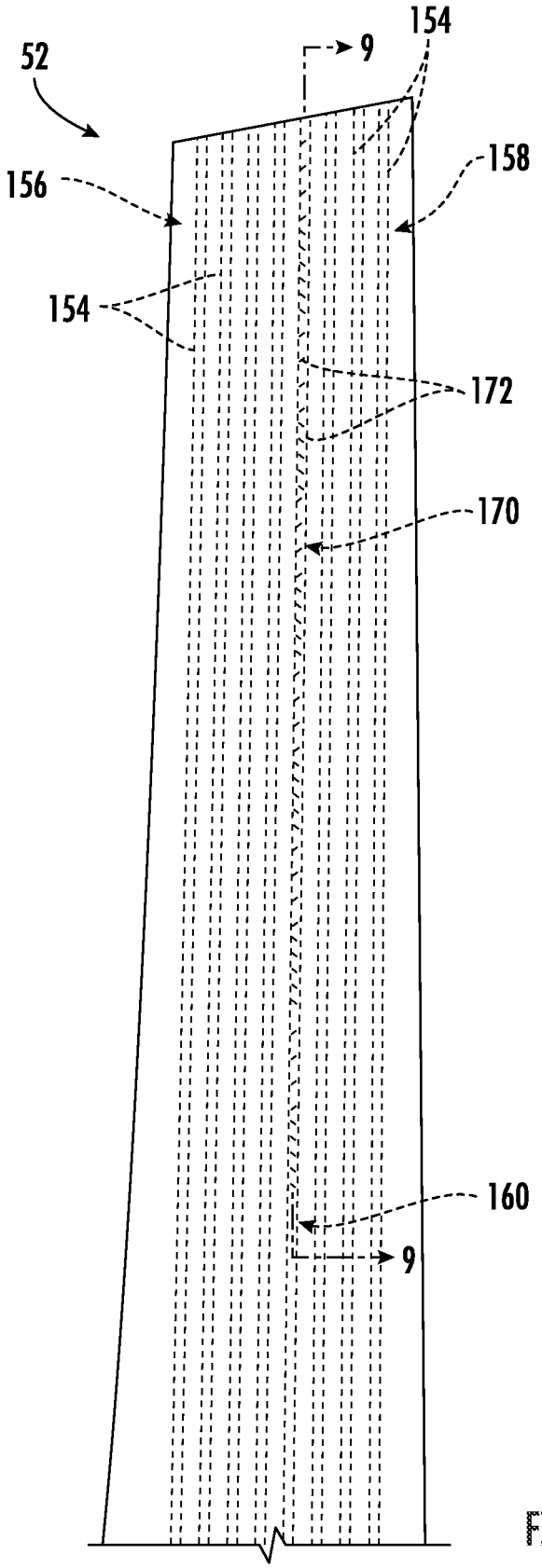
FIG. 8 illustrates an airfoil with viscous dampers, in accordance with embodiments of the present disclosure.
Figure 9:
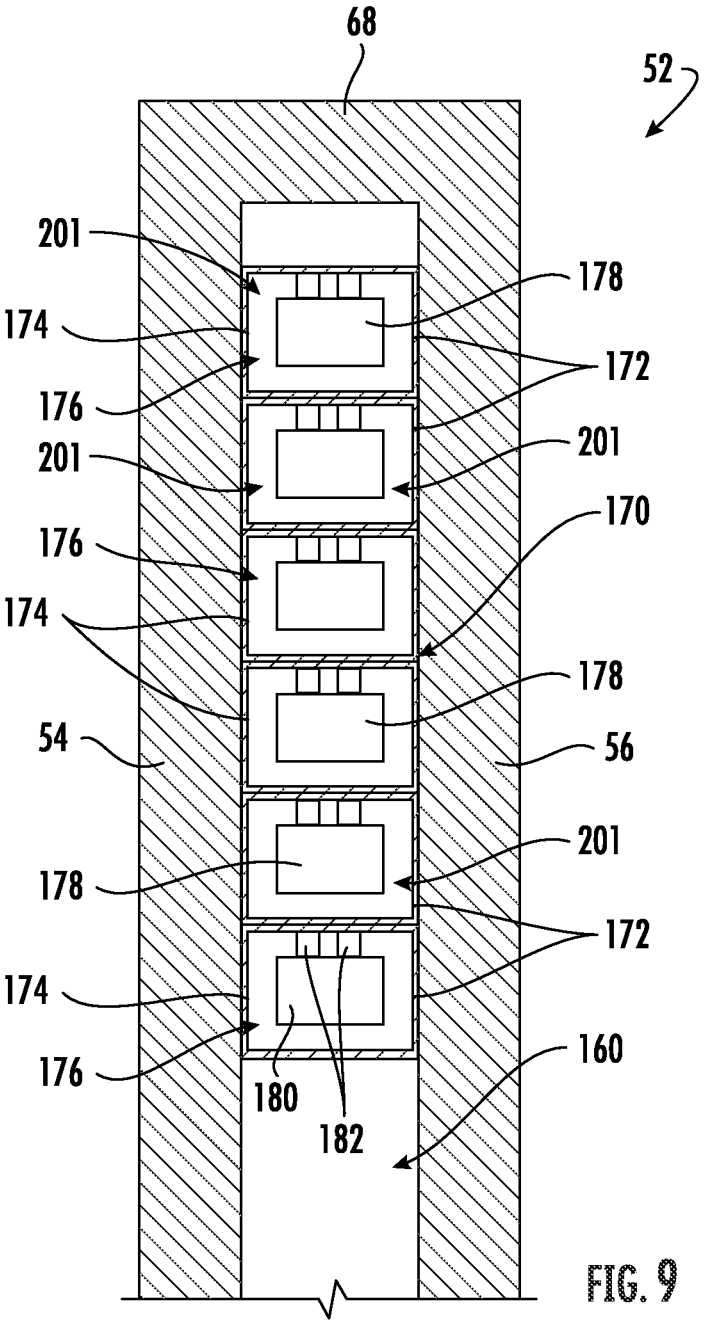
FIG. 9 illustrates a cross-sectional view of the airfoil shown in FIG. 8 from along the line 9-9, in accordance with embodiments of the present disclosure.

FIG. 8 illustrates an airfoil 52, in which the dashed lines represent internal passages, and FIG. 9 illustrates a cross section of the airfoil 52 from along the line 9-9 shown in FIG. 8, in accordance with embodiments of the present disclosure. As shown, one or more cooling passages 154 may be defined in the airfoil 52. Each cooling passage 154 may extend radially through the airfoil 36 (as shown). In some embodiments (not shown), each of the cooling passages 154 may extend radially through the platform 66 and/or the shank 51. Additionally, one or more cooling passages 154 may be connected to form a cooling circuit. FIG. 8 illustrates a first cooling circuit 156 and a second cooling circuit 158, each of which includes a plurality of connected cooling passages 154. A cooling medium (such as air or steam) may be flowed through the cooling passages 154 to cool rotor blade 50 during operation.

One or more damping passages 160 may be defined in and extend radially through the airfoil 52. In some embodiments, a damping passage 160 may be one of the cooling passages 154. In other embodiments, the damping passage 60 may be separate and independent from the cooling passages 154, such that cooling medium is not flowed through the damping passage 160. Damping passage 160 may extend and be defined radially through the entire rotor blade 50 or only a portion thereof. For example, as discussed, at least a portion of (which may be the entire) damping passage 160 may extend and be defined through the airfoil 52.

As shown in FIGS. 8 and 9, one or more viscous damper stacks 170 may be provided in the airfoil 52 in accordance with the present disclosure. Each viscous damper stack 170 may be disposed within a damping passage 160. Each damper stack 170 may include a plurality of vibrational dampening elements 172 in contact with one another (e.g., stacked together). As should be understood and appreciated, each vibrational dampening element 172 may be any one of the vibrational dampening elements discussed herein, such as the vibrational dampening element 300 shown and described with reference to FIGS. 13-16, or the vibrational dampening element 400 shown and described with reference to FIGS. 17-20. Each vibrational dampening element 172 may be in contact with a neighboring vibrational dampening element 172 in the viscous damper stack 170 and may further be in contact with walls defining the damping passage 160 (e.g., a channel defined between the pressure side wall 54 and the suction side wall 56).

As shown in FIG. 9, each vibrational dampening element 172 may include a casing 174 that defines a fluid chamber 176. A mass 178 may be disposed in the fluid chamber 176 and may be free to move within the fluid chamber 176 under operating conditions of the rotor blade 50. Each mass 178 may include a main body 180 and one or more protrusions 182 extending from the main body 180.

Additionally, glass 201 may fill each of the fluid chambers 176, such that the mass 178 is generally surrounded by glass 201 within the casing 174. Each mass 178 may be fully movable within the glass 201 and in the respective fluid chamber 176 defined by the respective casing 174 (e.g., when the rotor blade 50 is at operating temperature). In some embodiments, the mass 178 may be entirely detached from the respective casing 174. In other embodiments, the mass 178 may be attached to the respective casing 174 on one end (e.g., via one or more of the protrusions 182).

The use of viscous damper stacks 170 in accordance with the present disclosure advantageously provides improved damping of rotor blades 50. For example, by providing such damper stacks 170 internally in individual rotor blades 50, the viscous damper stacks 170 operate to dampen the absolute motion of the individual rotor blades 50 regardless of the relative motion between neighboring blades. Each vibrational dampening element 172 in the viscous damper stack 170 may generate its own viscous dampening forces that reduce the vibrations of the rotor blade 50. However, the use of viscous damper stacks 170 may be particularly advantageous, as the relative sliding contact between the casings 174 (and/or between the dampening elements 172 and the walls of the damping passage 160) will the increase the overall damping effectiveness. In some embodiments, each vibrational dampening element 172 in the viscous damper stack 170 may share a common casing, such that a singular casing defines multiple fluid chambers filled with glass and having a respective mass disposed therein. Additionally, each vibrational dampening element 172 in the viscous damper stack 170 may have a different type of glass disposed in the respective fluid chambers 176, which may allow damping to be tuned to different modes as a function of spanwise location and temperature.

Figure 10:
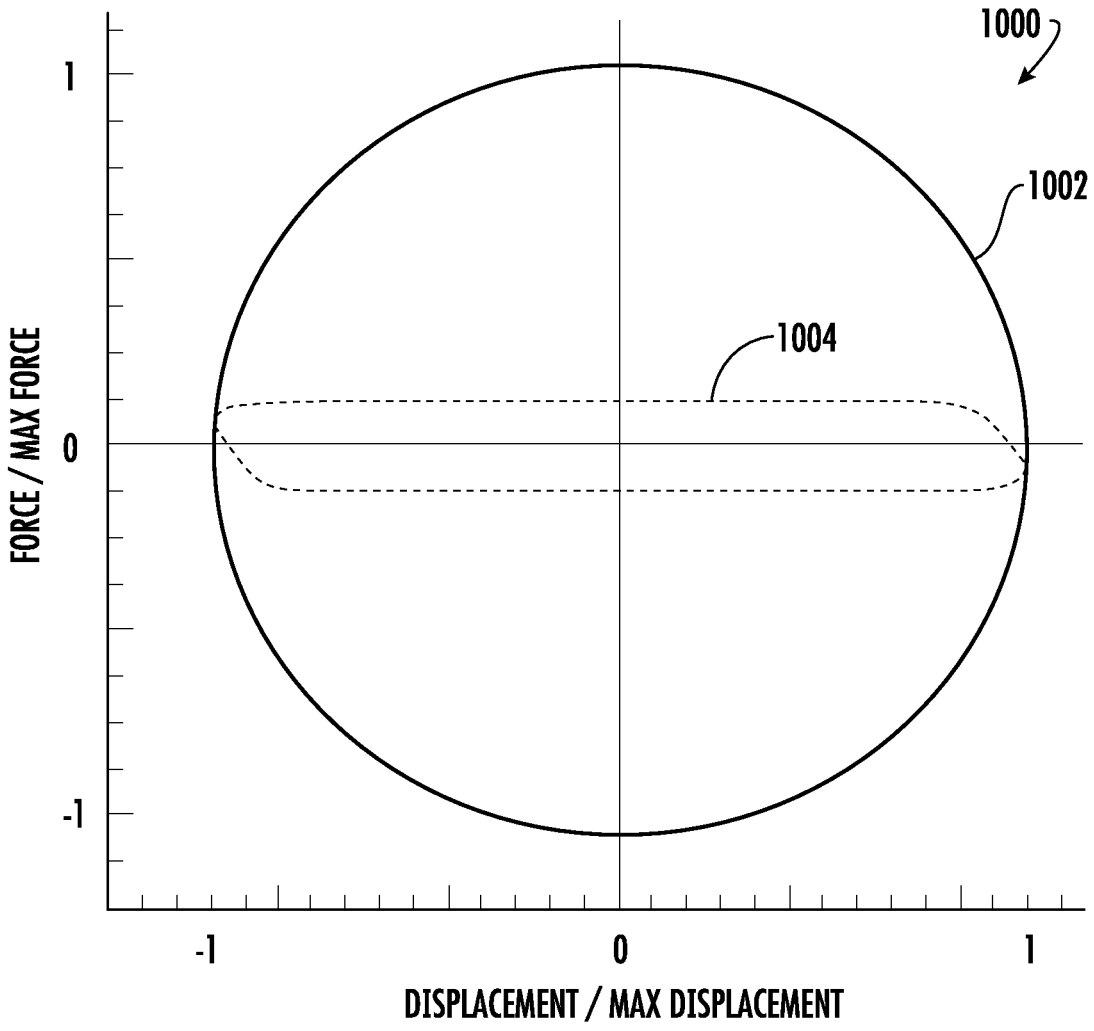
FIG. 10 illustrates a graph of a force displacement loop, in accordance with embodiments of the present disclosure.

Referring now to FIG. 10, a graph 1000 of a force displacement loop is illustrated in accordance with embodiments of the present disclosure. For example, FIG. 10 may illustrate the force experienced by the mass (such as the mass 202, 230, 308, or 408) as a result of its displacement within a fluid. The y-axis is a ratio between the force experienced by the mass and the maximum force experienced by the mass. The x-axis is a ratio between the displacement of the mass within the fluid chamber and the maximum displacement of the mass within the fluid chamber. Particularly, the solid line 1002 may illustrate the force (such as the reactive force) experienced by a mass as a result of its displacement within a Newtonian viscous fluid. By contrast, the dashed line 1004 may illustrate the force (such as the reactive force) experienced by a mass as a result of its displacement within a non-Newtonian viscous fluid (particularly a shear-thinning fluid).

As shown, the solid line 1002 or Newtonian force-displacement loop is generally circular or elliptical in shape. By contrast, as shown by the dashed line 1004, the shear-thinning effects of the non-Newtonian fluid causes the loop to be more "rectangular": The force rises sharply as the mass moves away from the extreme displacement position (e.g., ±1) then remains relatively constant along most of the stroke. When the mass accelerates the shear rate (0 increases, but the viscosity ($\eta$) decreases, resulting in a much smaller rise of the stress $\tau=\eta\dot{\gamma}$. The opposite happens during deceleration of the mass. Therefore, the variation of the force is mild along most of the piston stroke, which is desirable as it maximizes the absorbed energy for a given force capacity.

Utilizing glass 201 as a viscous damping fluid within the rotor blade 50 or within a vibrational dampening element 172, 300, 400 may be particularly advantageous due to the shear thinning behavior of the glass 201. For example, the glass 201 may be shear thinning such that as an acceleration of the mass 202 increases within the glass 201, a resistive shear force of the glass 201 decreases. For example, at operating temperatures, the shear thinning property of the viscous semi-molten glass may provide a relatively constant force upon a damper mechanism (e.g., the respective masses 202, 230, 308, 408). For example, the mass oscillates within the molten glass in response to vibrations of the turbomachine component. The damping force also varies less with frequency for shear-thinning fluids than with shear-thickening viscous fluids or Newtonian fluids. This behavior—due to shear thinning—maximizes the absorbed energy for a given damper designed to provide a certain maximum damper force.

Figure 11:
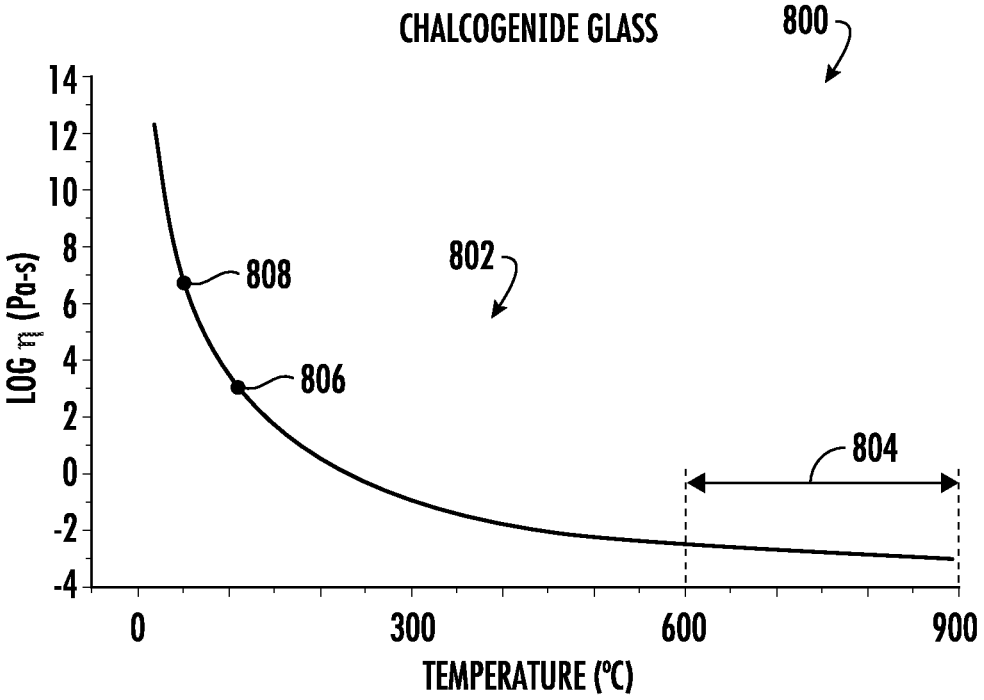
FIG. 11 illustrates a graph of the viscosity of a chalcogenide glass plotted against temperature, in accordance with embodiments of the present disclosure.

As should be understood and appreciated, the viscosity of a fluid is a measure of its resistance to deformation at a given rate. The viscosity of glass is typically measured in Pascal Seconds (Pa-s) and is represented by the Greek letter eta ($\eta$). The viscosity of glass changes with temperature. There are four temperature points used to define the viscosity of glass, e.g., strain, annealing, softening, and working. The strain point of a glass is the temperature of the glass at a viscosity of $\eta=10^{13.5}$ Pa-s. The annealing point of a glass is the temperature of the glass at a viscosity of $\eta=10^{12}$ Pa-s. The softening point of a glass is the temperature of the glass at a viscosity of $\eta=10^{6.65}$ Pa-s. The working point of a glass is the temperature of the glass at a viscosity of $\eta=10^{3}$ Pa-s. For the purposes of dampening, such as within the rotor blade 50 or within a vibrational dampening element attached to the rotor blade 50, the glass 201 may have a softening temperature (e.g., the temperature of the glass 201 at a viscosity of $\eta=10^{6.65}$) that is lower than the operating temperature of the rotor blade 50 (as shown in FIG. 11). During operation of the rotor blade 50, the glass 201 may have a viscosity capable of dampening vibrations of the rotor blade 50.

In embodiments described herein, the softening temperature of the glass 201 employed in the viscous dampers described herein is lower than the operating temperature of the rotor blade 50 when employed in a turbomachine. With such properties, the glass 201 will undergo viscosity transition, that is a gradual and reversible transition from a hard and relatively brittle "glassy" state into a viscous or rubbery state as the temperature of the turbine blade 50 is increased.

For example, in exemplary embodiments, the glass 201 may have a softening temperature 808, 908 (e.g., the temperature of the glass 201 at a viscosity of $\eta=10^{6.65}$) of between about 100° C. to about 900° C. In other embodiments, the glass 201 may have a softening temperature 808, 908 of between about 100° C. to about 700° C. In many embodiments, the glass 201 may have a softening temperature 808, 908 of between about 100° C. to about 600° C. In various embodiments, the glass 201 may have a softening temperature 808, 908 of between about 100° C. to about 500° C. In some embodiments, the glass 201 may have a softening temperature 808, 908 of between about 100° C. to about 400° C. In particular embodiments, the glass 201 may have a softening temperature 808, 908 of between about 100° C. to about 300° C. With some glass compositions, it may be particularly advantageous for the softening temperature (e.g., 801) to be lower than the operating temperature range (e.g., 804) of the rotor blade 50, such that all of the glass 201 within the rotor blade 50 will advantageously experience a decrease in viscosity with increased temperature (e.g., soften or liquify with an increase in temperature), thereby allowing the mass 202, 230 to move within the respective fluid chamber 200, 228 and damp the oscillations of the rotor blade 50.

Additionally, in some embodiments, the glass 201 may have a working temperature 806, 906 (e.g., the temperature of the glass 201 at a viscosity of $\eta=10^{3}$) that is between about 100° C. and about 1000° C. In other embodiments, the glass 201 may have a working temperature 806, 906 that is between about 100° C. and about 800° C. In many embodiments, the glass 201 may have a working temperature 806, 906 that is between about 100° C. and about 600° C. In further embodiments, the glass 201 may have a working temperature 806, 906 that is between about 100° C. and about 400° C.

In many embodiments (e.g., embodiments using chalcogenide glass as represented in FIG. 11), the glass 201 may include a viscosity of between about $10^{-4}$ pascal seconds (Pa-s) and about $10^{-2}$ Pa-s at a temperature of between about 600° C. and about 900° C. For example, the viscosity of the glass 201 may decrease from about $10^{-2}$ Pa-s (at a temperature of about 600° C.) to a viscosity of about $10^{-4}$ Pa-s (at a temperature of about 900° C.) as the temperature increases from about 600° C. and about 900° C. In certain embodiments, the glass 201 may include a viscosity of between about $10^{-4}$ pascal seconds (Pa-s) and about 10 Pa-s at a temperature of between about 600° C. and about 900° C. For example, the viscosity of the glass 201 may decrease from about 10 Pa-s (at a temperature of about 600° C.) to a viscosity of about $10^{-4}$ Pa-s (at a temperature of about 900° C.) as the temperature increases from about 600° C. and about 900° C. In other embodiments, the glass 201 may include a viscosity of between about $10^{-3}$ pascal seconds (Pa-s) and about 10 Pa-s at a temperature of between about 600° C. and about 900° C. For example, the viscosity of the glass 201 may decrease from about 10 Pa-s (at a temperature of about 600° C.) to a viscosity of about $10^{-3}$ Pa-s (at a temperature of about 900° C.) as the temperature increases from about 600° C. and about 900° C. In yet still further embodiments, the glass 201 may include a viscosity of between about $10^{-2}$ pascal seconds (Pa-s) and about 10 Pa-s at a temperature of between about 600° C. and about 900° C. For example, the viscosity of the glass 201 may decrease from about 10 Pa-s (at a temperature of about 600° C.) to a viscosity of about $10^{-2}$ Pa-s (at a temperature of about 900° C.) as the temperature increases from about 600° C. and about 900° C.

As discussed below in more detail, the glass 201 may be selected from a variety of glass types. However, in particularly advantageous embodiments, the glass 201 may be a glass having a softening point and/or a working point that is below the operating temperature range of the rotor blade (e.g., lower than about 700° C.), such that the glass 201 may flow, move, and act as a viscous fluid within the rotor blade 50 when at operating temperatures. For example, in various embodiments, the glass 201 may be a chalcogenide glass (such as the chalcogenide glass 802 with a viscosity profile shown in FIG. 11) and/or a sealing glass (such as the sealing glass 902 with a viscosity profile shown in FIG. 12).

FIG. 11 illustrates a graph 800 of the viscosity (Pa-s) of a chalcogenide glass 802 plotted against temperature (° C.). In particular embodiments, the glass 201 may be the chalcogenide glass 802 having a viscosity that changes with temperature generally (e.g., ±10%) in accordance with FIG.

11. A chalcogenide glass is a glass containing one or more chalcogens (such as sulfur, selenium and tellurium, but excluding oxygen). For example, in many embodiments, the chalcogenide glass 802 may include both selenium (Se) and tellurium (Te). In exemplary embodiments, the chalcogenide glass may include a greater proportion of selenium than tellurium. For example, the chalcogenide glass may have various proportions of selenium and tellurium, such as $Se_{90}Te_{10}$, $Se_{80}Te_{20}$, or $Se_{70}Te_{30}$. The chalcogenide glass 802 may advantageously have a working point 806 and a softening point 808 that are below the operating temperature range 804 of the rotor blade 50.

Figure 12:
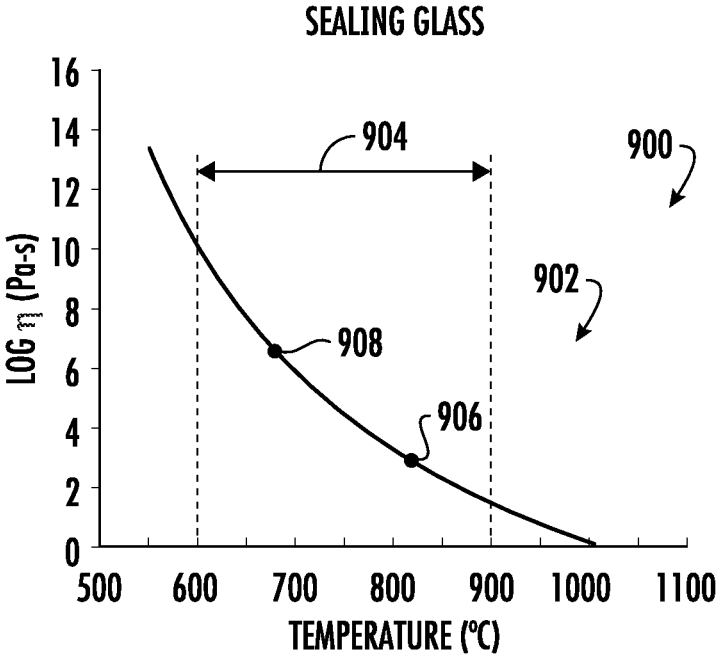
FIG. 12 illustrates a graph of the viscosity of a sealing glass plotted against temperature, in accordance with embodiments of the present disclosure.

FIG. 12 illustrates a graph 900 of the viscosity (Pa-s) of a sealing glass 902 plotted against temperature (° C.). In particular embodiments, the glass 201 may be the sealing glass 902 having a viscosity that changes with temperature generally (e.g., ±10%) in accordance with FIG. 12. The sealing glass 902 may advantageously have a working point 906 and a softening point 908 that are within the operating temperature range 904 of the rotor blade 50.

As shown in FIGS. 11 and 12, the rotor blade 50 may include an operating temperature (such as a steady-state material operating temperature of the rotor blade 50 within the turbomachine) of between about 600° C. and about 900° C. For example, the operating temperature may be the temperature of the rotor blade 50 during operation of the turbomachine. In other embodiments, the rotor blade 50 may include an operating temperature of between about 650° C. and about 850° C. In many embodiments, the rotor blade 50 may include an operating temperature of between about 700° C. and about 800° C. Additionally, and advantageously, one or both of the softening temperature (e.g., the temperature of the glass 201 at a viscosity of $\eta=10^{6.65}$) and the working temperature (e.g., the temperature of the glass 201 at a viscosity of $\eta=10^{3}$) of the glass 201 may fall within or below the operating temperature range 804, which allows the glass 201 to be used as a viscous damping fluid for the rotor blade 50.

Figure 13:
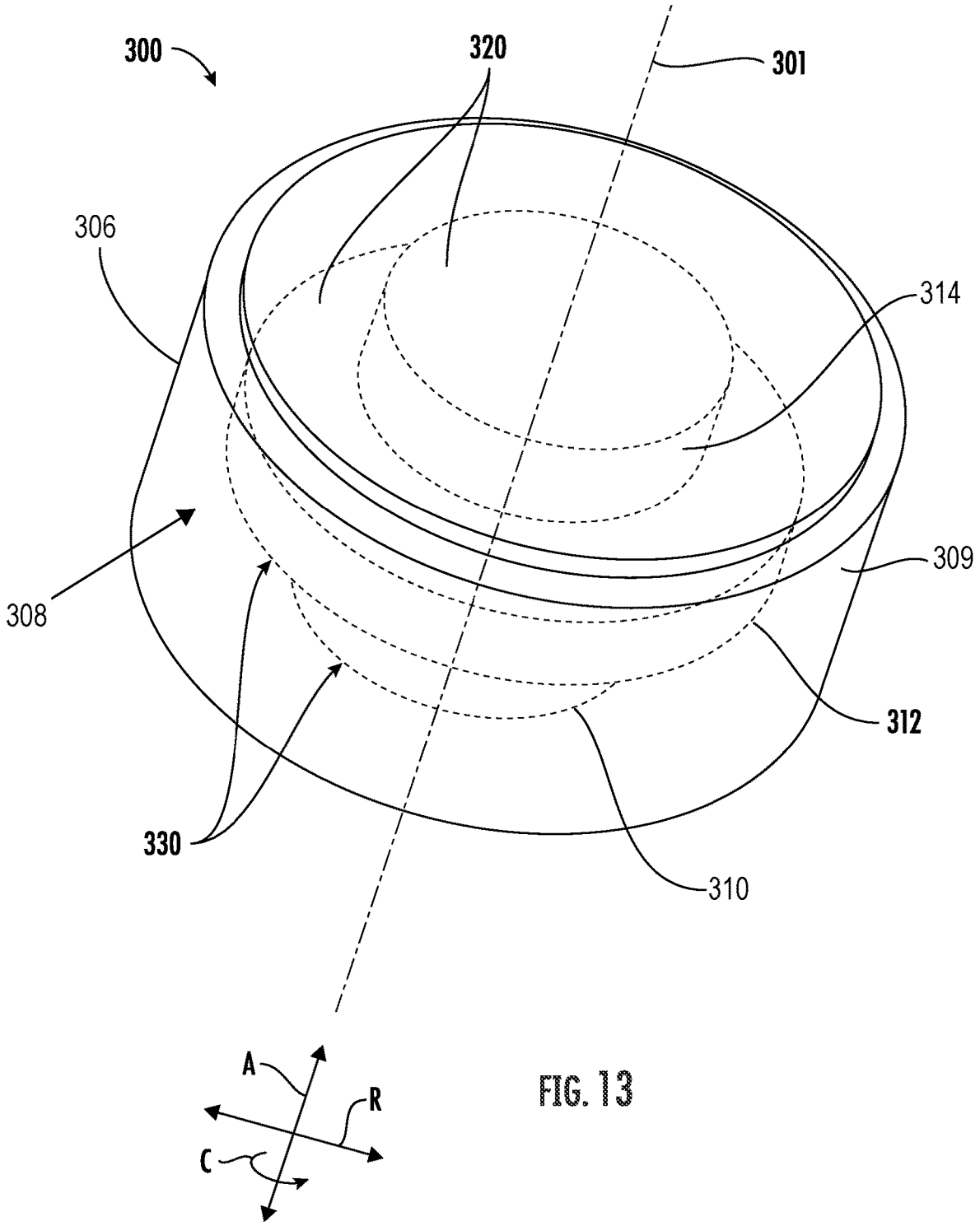
FIG. 13 illustrates a perspective view of a vibrational dampening element, in accordance with embodiments of the present disclosure.

Referring back to FIG. 3 and simultaneously to FIG. 13, a vibrational dampening element 300 may be attached to or within the rotor blade 50, in order to adjust the amplitude of oscillations of the rotor blade 50 when the gas turbine 10 is in operation. As shown, in some embodiments, the vibrational dampening element(s) 300 may be attached proximate the leading edge 58 of the airfoil 52. In other embodiments (not shown), the vibrational dampening element(s) 300 may be attached proximate the trailing edge 60, on or underneath the platform 66, on or within the pressure side wall 54, on or within the suction side wall 56, and/or on or within the shank 51.

In exemplary embodiments, the vibrational damping element 300 may be attached to the interior of the rotor blade 50, e.g., by welding or brazing, such that it reduces and/or eliminates the oscillations of the rotor blade 50 without creating any impediment to the flow of combustion gases over the exterior of the airfoil 52. For example, the vibrational damping element(s) 300 may be disposed within the airfoil 52, such that they are fixedly coupled to an interior surface of the airfoil 52. In such embodiments, the vibrational damping element 300 may be housed within the airfoil 52, thereby advantageously providing damping to the rotor blade 50 without creating any blockage to the flow of combustion gases 34. In other embodiments (not shown), the vibrational damping 300 element may be directly fixedly coupled to the exterior surface of the airfoil 52, e.g., by welding and/or brazing. The vibrational dampening element 300 may be large enough to significantly decrease and/or eliminate damage-causing vibrations of the airfoil 52 during operation, but small enough not to cause an impediment to the flow of combustion gases over the airfoil 52, thereby maintaining the aerodynamic efficiency of the rotor blade 50.

As shown in FIG. 3, one or more vibrational dampening elements 300 may be positioned along various locations of the airfoil 52, e.g., between 0% and 100% of the span length 70 of the airfoil 52. For example, the rotor blade 50 may include one or more mid-span vibrational dampening elements 302, which may be positioned in the mid-span region of the airfoil 52. For example, the mid-span vibrational dampening element(s) 302 may be positioned on the airfoil 52 between about 25% and about 75% of the span length 70 of the airfoil 52. In particular embodiments, one or more vibrational dampening elements 300 may be positioned on the airfoil 52 between about 40% and about 60% of the span length 70 of the airfoil 52.

As shown in FIG. 3, the rotor blade 50 may further include one or more tip-span vibrational dampening elements 304, which are radially separated from the mid-span vibrational dampening element(s) 302. In various embodiments, the tip-span vibrational dampening element(s) 304 may be positioned between about 75% and about 100% of the span length 70 of the airfoil 52. In particular embodiments, the tip-span vibrational dampening element(s) 304 may be positioned between about 90% and about 100% of the span length 70 of the airfoil 52.

In many embodiments, each of the dampening elements 302, 304 may be sized differently, in order to target a specific frequency range of the rotor blade 50. For example, the tip-span vibrational damping element(s) 304 may be sized such that they are tuned to natural frequencies where the rotor blade 50 mode of vibration is predominantly at the tip. Similarly, the mid-span vibrational dampening element 302 may be sized such that they are tuned to natural frequencies where the rotor blade 50 mode of vibration is predominantly in the mid-span region. For example, each vibrational dampening element 300 may be sized to be tuned to a frequency of the rotor blade 50 based on the respective span locations of the airfoil 52 to which they are attached or embedded.

Figure 15:
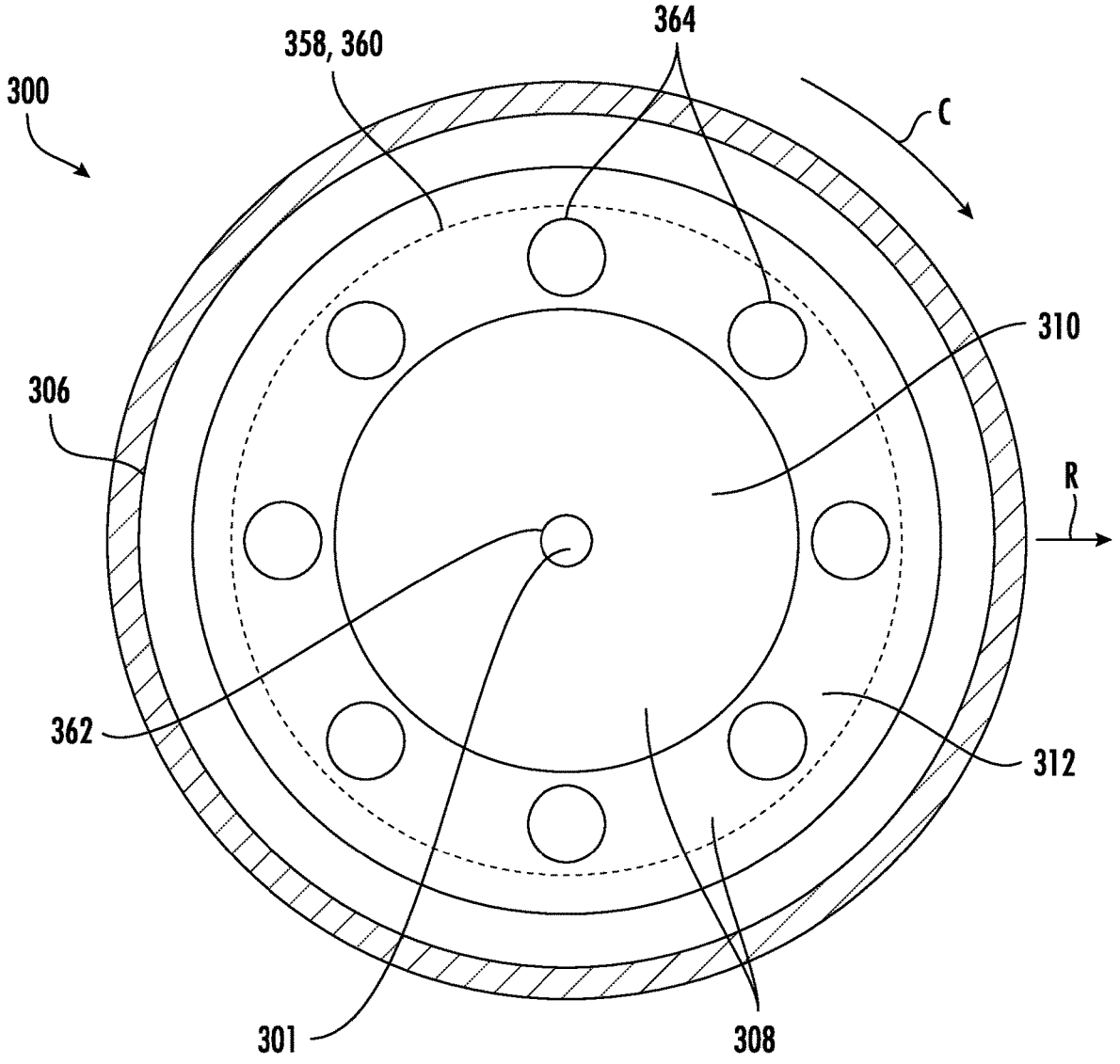
FIG. 15 illustrates a cross-sectional view of the vibrational dampening element shown in FIG. 13 from along an axial centerline of the vibrational dampening element, in accordance with embodiments of the present disclosure.

FIG. 13 illustrates a perspective view of an exemplary vibrational dampening element 300, FIG. 14 is a cross-sectional view of the vibrational dampening element 300 from along a radial direction R, and FIG. 15 is a cross-sectional view of the vibrational dampening element 300 from along line 15-15 of FIG. 14. As shown, the axial centerline 301 of the vibrational dampening element 300 defines an axial direction A substantially parallel to and/or along axial centerline 301, a radial direction R perpendicular to axis A, and a circumferential direction C extending around axis A. In exemplary embodiments, the axial centerline 301 of the vibrational dampening element 300 may be aligned (or coaxial) with the direction of oscillations or vibrations of the component to which it is attached.

In many embodiments, the vibrational dampening element 300 includes a casing 306 that encapsulates or surrounds a mass 308. For example, as shown in FIG. 14, the casing 306 may be spaced apart from the mass 308, such that a fluidic chamber 309 is defined in the space between the mass 308 and the casing 306. In this way, the mass 308 may be suspended in fluid within the casing 306, such that the mass 308 is capable of movement relative to the casing 306 and within the fluid. For example, when the vibrational dampening element 300 is attached to an oscillating component, the mass 308 may oscillate within the fluid encapsulated by the casing 306, which forces the fluid between the fluidic portions 318, 328 of the fluidic chamber 309 defined between the casing 306 and the mass 308, thereby dampening the oscillations of the component.

In exemplary embodiments, a fluidic chamber 309 may be defined between the mass and the casing and filled with a fluid (such as glass, or particularly glass 201 described above). For example, the casing 306 may define an interior surface having a shape that mimics an exterior surface shape of the mass 308. In various embodiments, the interior surface of the casing 306 may be spaced apart from the mass 308, thereby defining the fluidic chamber 309 in the space between the mass 308 and the casing 306. In many embodiments, the fluidic chamber 309 may include a first fluidic portion 318 and a second fluidic portion 328. The first fluidic portion 318 may be defined between a first side 320 of the mass 308 and the casing 306, and the second fluidic portion 328 may be defined between a second side 330 of the mass 308 and the casing 306.

In exemplary embodiments, the mass 308 may include a main body 310 and a member or annular member 312 that extends from the main body 310. For example, the annular member 312 may extend in the circumferential direction C and surround the main body 310 of the mass 308, such that mass 308 defines a circular cross-sectional shape (FIG. 15). In many embodiments, the main body 310 of the mass 308 may define a first thickness 314 from the first side 320 to the second side 330 of the main body 310, and the annular member 312 of the mass 308 may define a second thickness 316 from the first side 320 to the second side 330 of the annular member 312. As shown in FIG. 14, the second thickness 316 of the annular member 312 may be smaller than the first thickness 314 of the main body 310. With this configuration, the majority of the weight of the mass 308 may be centrally located, i.e., proximate the axial centerline 301 of the vibrational dampening element 300.

As discussed above, a first fluidic portion 318 of the fluidic chamber 309 may be disposed between the first side 320 of the mass 308 and the casing 306. As shown, the first fluidic portion 318 may include a first central portion 322 that extends along the main body 310 on the first side 320, a first accumulator portion 324 that extends along the annular member 312 on the first side 320, and a first connection portion 326 disposed between the first central portion 322 and the first accumulator portion 324. For example, the first central portion 322 may be disposed axially between the first side 320 of the main body 310 and the casing 306 with respect to the axial centerline 301 of the vibrational dampening element 300. The first accumulator portion 324 may be defined axially between the first side 320 of the annular member 312 and the casing 306. The first connection portion 326 may be defined radially between the main body 310 and the casing 306. In various embodiments, both the first accumulator portion 324 and the first connection portion 326 may be annular passageways that are defined in the circumferential direction C. For example, the first central portion 322 may extend radially between the axial centerline 301 and the first connection portion 326, such that the first connection portion 326 provides for fluid communication between the first central portion 322 and the first accumulator portion 324 of the first fluidic portion 318.

In particular embodiments, as discussed, a second fluidic portion 328 of the fluidic chamber 309 may be disposed between a second side 330 of the mass 308 and the casing 306. As shown, the second fluidic portion 328 may include a second central portion 332 that extends along the main body 310 on the second side 330, a second accumulator portion 334 that extends along the annular member 312 on the second side 330, and a second connection portion 336 disposed between the second central portion 332 and the second accumulator portion 334. For example, the second central portion 332 may be disposed axially between the second side 330 of the main body 310 and the casing 306 with respect to the axial centerline 301 of the vibrational dampening element 300. The second accumulator portion 334 may be defined axially between the second side 330 of the annular member 312 and the casing 306. In various embodiments, both the second accumulator portion 334 and the second connection portion 326 may be annular passageways that are defined in the circumferential direction C. For example, the second central portion 332 may extend radially between the axial centerline 301 and the second connection portion 336, such that the second connection portion 336 provides for fluid communication between the second central portion 332 and the second accumulator portion 334 of the second fluidic portion 328.

In various embodiments, the vibrational dampening element 300 may further include a first bellows tube 358 that extends between the first side 320 of the annular member 312 and the casing 306 and a second bellows tube 360 that extends between the second side 330 of the annular member 312 and the casing. The bellows tubes 358, 360 may be compliant, such that they can bend or flex along the axial centerline 301 to allow for the mass to oscillate axially within the fluid and provide viscous damping forces when attached to a vibrating component (such as the turbine rotor blade 50). For example, in exemplary embodiments, mass 308 may suspended within fluid (e.g., glass 201) by the first bellows tube 358 and the second bellows tube 360. In various embodiments, the first bellows tube 358 and the second bellows tube 360 may be annular, such that they extend in the circumferential direction C around the main body 310 of the mass 308. In this way, the first bellows tube 358 and the second bellows tube 360 may surround the main body 310 of the mass 308 and partially define the first fluidic portion 318 and the second fluidic portion 328 respectively.

As shown in FIGS. 14 and 15, a primary passage 362 may extend between the first fluidic portion 318 and the second fluidic portion 328, in order to provide for fluid communication therebetween. For example, the primary passage 362 may extend directly from the first central portion 322 of the first fluidic portion 318 to the second central portion 332 of the second fluidic portion 328. In various embodiments, the primary passage 362 may extend along the axial centerline 301 of the vibrational dampening element 300, such that the primary passage 362 extends coaxially with the axial centerline 301. In other embodiments (not shown), multiple primary passages may extend between the first fluidic portion 318 and the second fluidic portion 328 of the fluidic chamber 309, such that they symmetrically surround the axial centerline 301 of the vibrational dampening element 300. In exemplary embodiments, when the vibrational dampening element 300 is attached to a vibrating or oscillating component (such as the turbomachine rotor blade 50 shown in FIG. 3 or the airfoil of FIG. 8), the primary passage 362 may be oriented generally along the direction of oscillations of the component.

In many exemplary embodiments, the vibrational dampening element 300 may further include a plurality of secondary passages 364 circumferentially spaced apart from one another and defined within the mass 308. The plurality of secondary passages 364 may be disposed around the periphery of the vibrational dampening element 300, such that they are positioned about and surround the axial centerline 301. In particular embodiments, each of the secondary passages 364 may be defined within the annular member 312, such that they each extend generally axially between the first fluidic portion 318 and the second fluidic portion 328. For example, each secondary passage 364 in the plurality of secondary passages 364 may extend through the annular member 312 from the first accumulator portion 324 of the first fluidic portion 318 to the second accumulator portion 334 of the second fluidic portion 328.

The vibrational dampening element 300 described herein may work on the principle of a tuned vibration absorber. For example, during operation of the vibrational dampening element 300, a fluid (such as glass, or particularly glass 201 described above) may flow between the first fluidic portion 318 and the second fluidic portion 328 via the primary passage 362 and the plurality of secondary passages 364. For example, when the vibrational dampening element 300 is attached to a vibrating component, such as a turbine rotor blade 50, the viscous forces generated in primary passage 362 and the secondary passages 364 from fluid rapidly traveling between the fluidic portions 318, 328 of the fluidic chamber 309 advantageously dampens the amplitude of oscillations of the vibrating component. The viscous damping forces produced within the vibrational dampening element 300 counteract the vibrations of the component to which the vibrational dampening element 300 is attached and advantageously reduce the amplitude of vibrations of the vibrating component.

In exemplary embodiments, the plurality of secondary passages 364 ensures no pressure build-up in the fluid within the accumulator portions 324, 334, i.e., around the periphery of the vibrational dampening element 300. In this way, the plurality of secondary passages 364 advantageously increase the effectiveness of the vibrational dampening element 300 by ensuring that there are no stiff regions.

In many embodiments, the natural frequency of the vibrational dampening element 300 may be tuned to the mode of interest by changing the stiffness of the bellows tubes 358, 360. Similarly, the natural frequency of the vibrational dampening element 300 may be tuned by adjusting the density, size, or weight of the mass 308. This advantageously allows for the vibrational dampening 300 element to be tuned based on the component to which it will be attached, e.g., the first, second, and/or third stage turbine rotor blades may each include a vibrational dampening element 300 that is separately and specifically tuned for each stage blade.

The vibrational dampening element 300 described herein may be advantageous over prior designs of dampening elements, e.g., damping elements having only single passage connecting two fluid chambers. For example, the accumulator portions 324, 334 and the plurality of secondary passages 364 ensure that no forces leak into stiffness around the periphery of the dampening element 300 and ensure no pressure build-up in the fluid surrounding the bellows tubes 358, 360.

Figure 16:
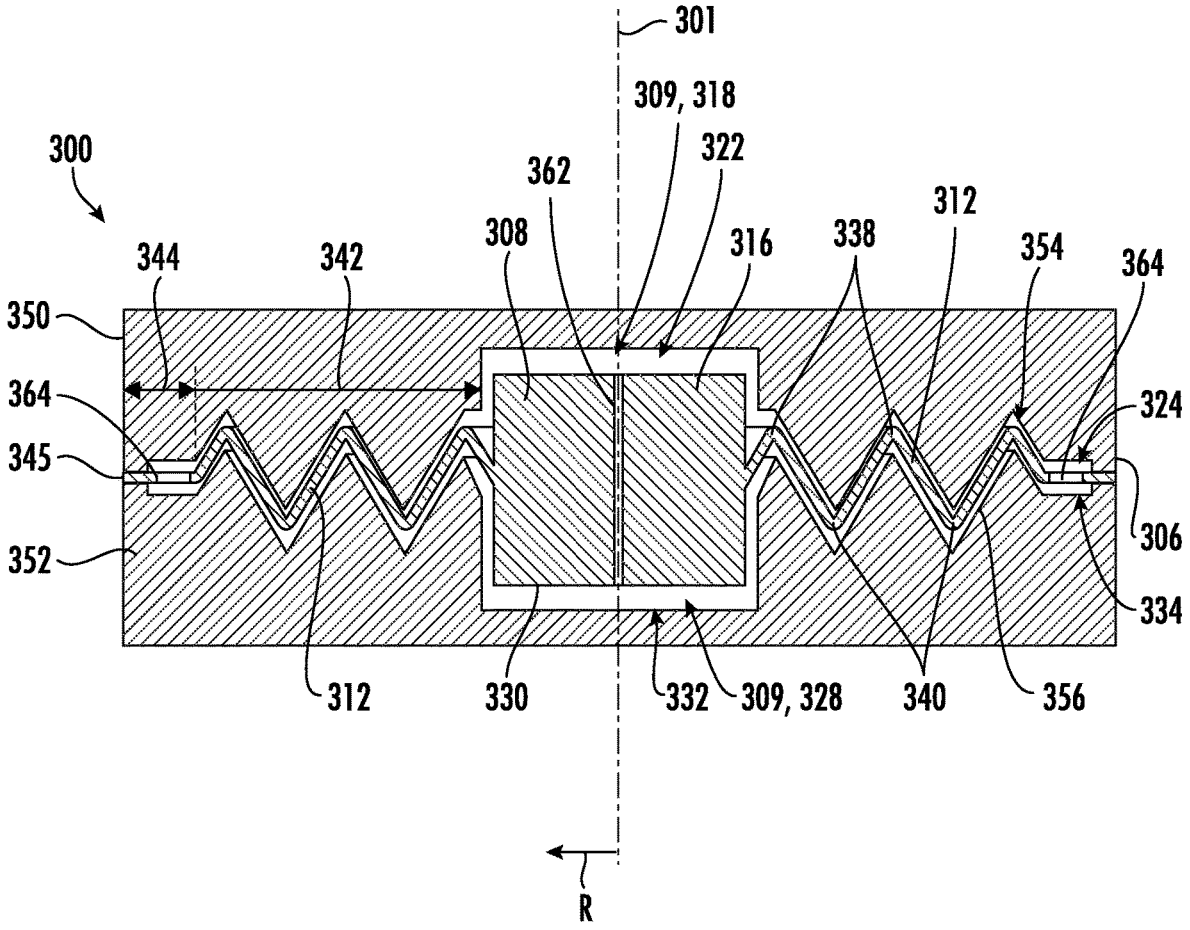
FIG. 16 illustrates a cross-sectional view of a vibrational dampening element from along a radial direction, in accordance with embodiments of the present disclosure.

FIG. 16 illustrates a cross-sectional view of a vibrational dampening element 300 from along a radial direction R, in accordance with other embodiments of the present disclosure. As shown, the annular member 312 may be corrugated such that it includes multiple wrinkles, folds, and/or ridges, which advantageously provides for increased compliance in the axial direction (i.e., the direction of oscillation of the mass 308 when attached to a vibrating component).

In various embodiments, the annular member 312 may extend continuously between a corrugated portion 342 and a straight portion 344. The corrugated portion 342 of the annular member 312 may extend continuously between a plurality of peaks 338 and valleys 340, which are radially and axially separated from one another. As shown in FIG. 16, the corrugated portion 342 of the annular member 312 may extend radially from the main body 310 to the straight portion 344. The straight portion 344 may extend radially from the corrugated portion 342 to a free end 345. In the embodiment shown in FIG. 16, the plurality of secondary passages 364 may be defined within the straight portion 344 of the annular member.

As shown in FIG. 16, the casing 306 may be generally spaced from the mass 308, in order to partially define the first fluidic portion 318 and the second fluidic portion 328 on either side of the mass 308. As shown, the casing 306 may include a first portion 350 and a second portion 352 that couple to opposite sides of the mass 308. For example, the first portion 350 may couple to the free end 345 on a first side of the annular member 312, and the second portion 352 of the casing 306 may couple to the free end 345 on a second side of the annular member 312.

In the embodiment shown in FIG. 16, the first fluidic portion 318 may further include a first corrugated passage 354 and a second corrugated passage 356 disposed on opposite sides of the corrugated portion 342 of the annular member 312. For example, the first corrugated passage 354 and the second corrugated passage 356 may extend along the corrugated portion 342 on opposite sides of the annular member 312. In such embodiments, as shown, the first accumulator portion 324 of the first fluidic portion 318 and the second accumulator portion 334 of the second fluidic portion 328 may extend along the straight portion 344 on opposite sides of the annular member 312.

Figure 17:
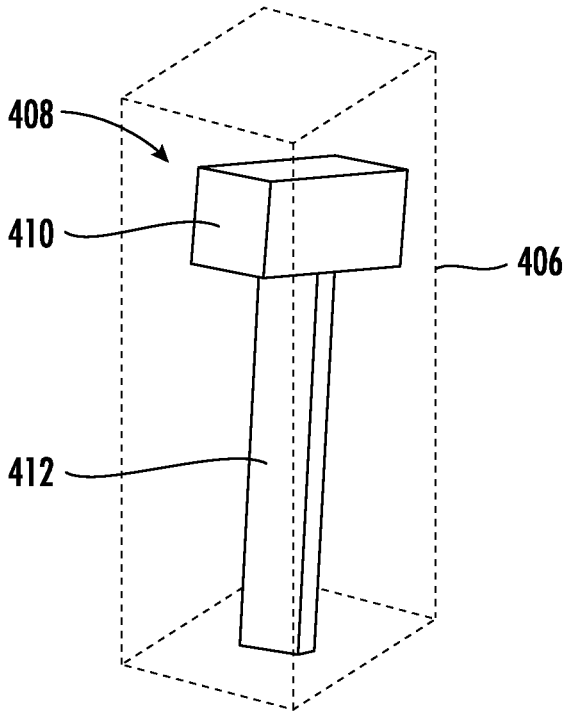
FIG. 17 illustrates a perspective view of a vibrational dampening element, in accordance with embodiments of the present disclosure.
Figure 18:
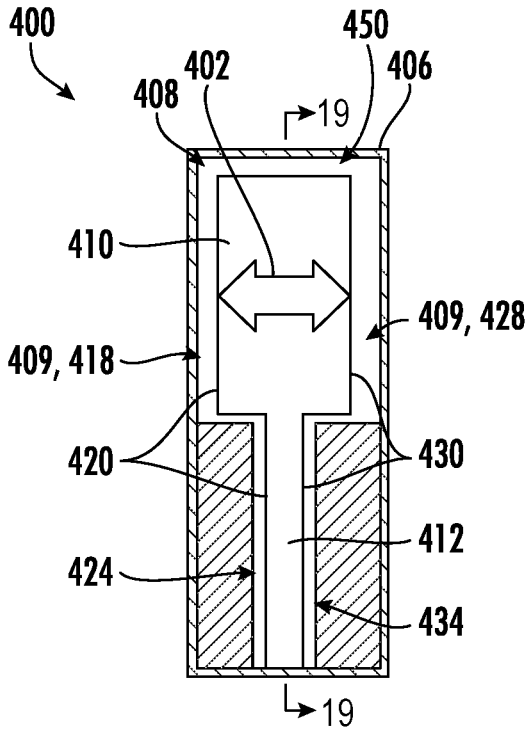
FIG. 18 illustrates a cross-sectional view of the vibrational dampening element shown in FIG. 17, in accordance with embodiments of the present disclosure.
Figure 19:
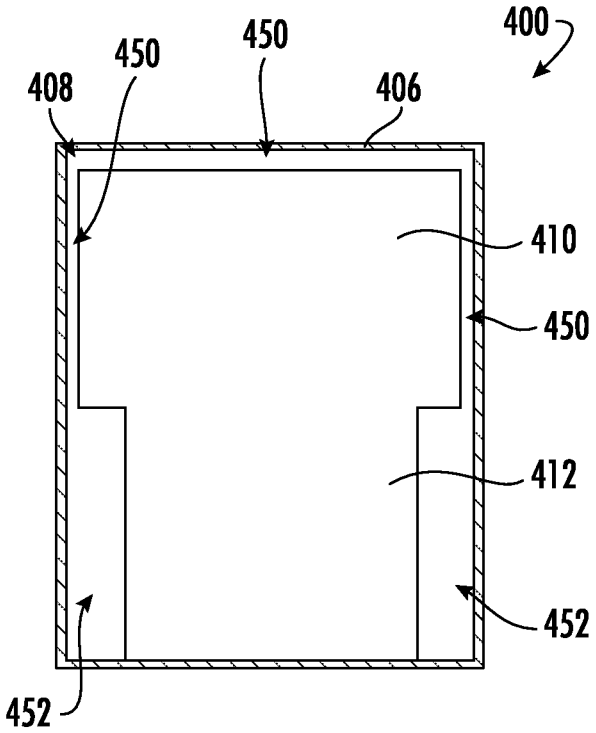
FIG. 19 illustrates a cross-sectional view of the vibrational dampening element shown in FIG. 17, in accordance with embodiments of the present disclosure.

FIGS. 17-19 illustrate a vibrational dampening element 400, in accordance with an alternative embodiment of the present disclosure. As shown, the vibrational dampening element 400 may be a "hammer" damper, such that it includes a large mass attached to a slender beam or member. FIG. 17 illustrates a perspective view of the vibrational dampening element 400, in which the casing 406 is shown in dashed lines. FIG. 18 illustrates a cross-sectional view of the vibrational dampening element 400 from along a first direction, and FIG. 19 illustrates a cross-sectional view of the vibrational dampening element 400 from along a second direction, which is perpendicular to the first direction.

In exemplary embodiments, the vibrational dampening element 400 may include a fluidic chamber 409 that is defined between a mass 408 and a casing 406 and filled with a fluid (such as glass, or particularly glass 201 described above). For example, the casing 406 may define an interior surface having a shape that mimics an exterior surface shape of the mass 408. In various embodiments, the interior surface of the casing 406 may be spaced apart from the mass 408, thereby defining the fluidic chamber 409 in the space between the mass 408 and the casing 406. In many embodiments, the fluidic chamber 409 may include a first fluidic portion 418 and a second fluidic portion 428. The first fluidic portion 418 may be defined between a first side 420 of the mass 408 and the casing 406, and the second fluidic portion 428 may be defined between a second side 430 of the mass 308 and the casing 306.

As shown in FIGS. 17-19 collectively, the vibrational dampening element 400 includes a casing 406 that encapsulates or surrounds a mass 408. As shown, the mass 408 may include a main body 410 and a member 412 that extends from the main body and couples to the casing 406. For example, as shown in FIGS. 18 and 19, the member 412 of the mass 408 may be attached to the casing 406 and cantilevered therefrom, such that the first fluidic portion 418 and the second fluidic portion 428 are defined in the space between the mass 408 and the casing 406. In this way, the main body 410 of the mass 408 may be capable of movement relative to the casing 406 and within the fluid held by the fluidic chamber 409. For example, when the vibrational dampening element 400 is attached to an oscillating component (such as a turbomachine rotor blade 50 or other component), the main body 410 of the mass 408 may oscillate within the fluid encapsulated by the casing 406, which forces the fluid to move between the fluidic portions 418, 428 of the fluidic chamber 409 defined between the casing 406 and the mass 408, thereby producing viscous forces that dampen the oscillations of the component.

As shown in FIGS. 18 and 19, the first fluidic portion 418 of the fluidic chamber 409 may be defined between a first side 420 of the mass 408 and the casing 406, and the second fluidic portion 428 of the fluidic chamber 409 may be defined between a second side 430 of the mass 408 and the casing 406. When the vibrational dampening element 400 is attached to a component (such as the turbomachine rotor blade 50 shown in FIG. 3), the first side 420 and the second side 430 may be generally perpendicular to a direction of vibrations 402 of the component, such that the fluidic portions 418, 428 of the fluidic chamber 409 are disposed opposite one another with respect to the direction of vibrations 402 of the component. In this way, the first fluidic portion 418 and the second fluidic portion 428 may extend generally perpendicularly to the direction of vibrations 402 of the component. In exemplary embodiments, primary passages 450 may extend along the main body 410 of the mass 408 generally parallel to the direction of vibrations 402 and fluidly couple the first fluidic portion 418 to the second fluidic portion 428.

In many embodiments, the first fluidic portion 418 of the fluidic chamber 409 may further include a first accumulator portion 424 that extends along the member 412 of the mass 408, and the second fluidic portion 428 may include a second accumulator portion 434 that extends along an opposite side of the member 412 as the first accumulator portion 424. For example, the first accumulator portion 424 and the second accumulator portion 434 may extend be disposed on opposite sides of the member 412 and may extend generally perpendicularly to the direction of vibrations 402 of the component. In exemplary embodiments, secondary passages 452 may extend along the member 412 generally parallel to the direction of to the direction of vibrations 402 and fluidly couple the first accumulator portion 424 to the second accumulator portion 434.

Figure 20:
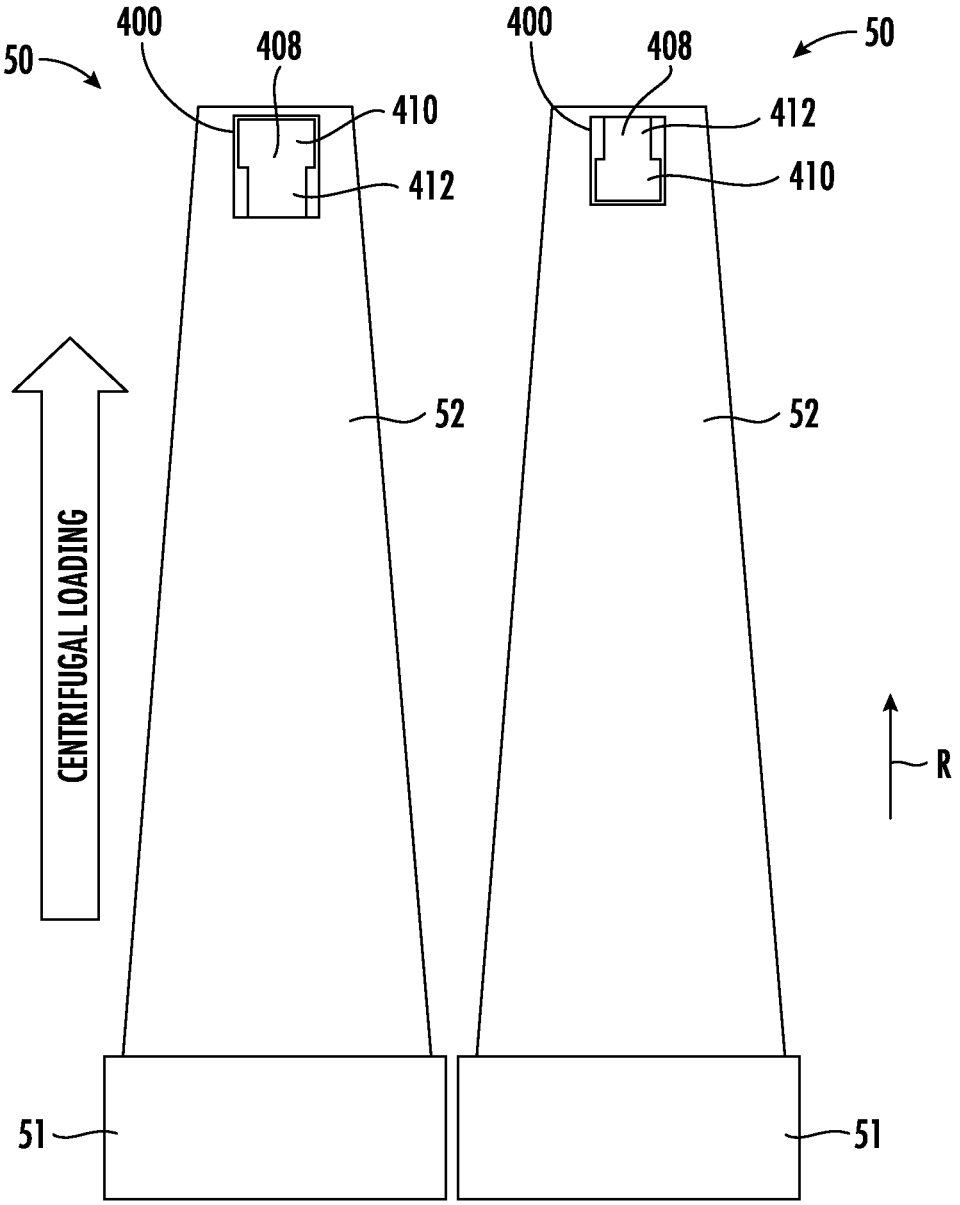
FIG. 20 illustrates two neighboring turbomachine rotor blades, including a first rotor blade in which the vibrational dampening element shown in FIG. 17 has been mounted in a first orientation and a second adjacent rotor blade in which the vibrational dampening element shown in FIG. 17 has been mounted in a second orientation, in accordance with embodiments of the present disclosure.

FIG. 20 illustrates two neighboring turbomachine rotor blades 50, a first of which has the vibrational dampening element 400 mounted in a first orientation and a second of which has the vibrational dampening element 400 mounted in a second direction opposite the first direction. As shown in the first rotor blade (left side of FIG. 20), the vibrational dampening element 400 may be mounted to or within the airfoil 52 such that the main body 410 of the mass 408 is radially outward of the member 412 with respect to the radial direction of the gas turbine 10. In such a configuration, the member 412 may be under a tensile centrifugal loading. In another configuration, as shown in the second rotor blade (right side of FIG. 20), the vibrational dampening element 400 may be mounted to or within the airfoil 52 such that the main body 410 of the mass 408 is radially inward of the member 412 with respect to the radial direction of the gas turbine 10. In such a configuration, the member 412 may be under a compressive centrifugal loading.

During operation of the vibrational dampening element 400, i.e., when the vibrational dampening element 400 is attached to an oscillating or vibrating component, fluid may be forced by the mass 408 to flow between the first fluidic portion 418 and the second fluidic portion 428 via the primary passages 450 and the secondary passages 452. For example, when the vibrational dampening element 400 is attached to or within an oscillating component, such as a turbine rotor blade 50, the viscous forces are generated in primary passages 450 and the secondary passages 452 from fluid rapidly traveling between the fluidic portions 418, 428 of the fluidic chamber 409. The viscous forces counteract the vibrations of the component and reduce the amplitude of oscillations of the component. In exemplary embodiments, the plurality of secondary passages 452 between the accumulator portions 424, 434 ensures no pressure build-up in the fluid within the accumulator portions 424, 434, i.e., around the member 412.

Figure 21:
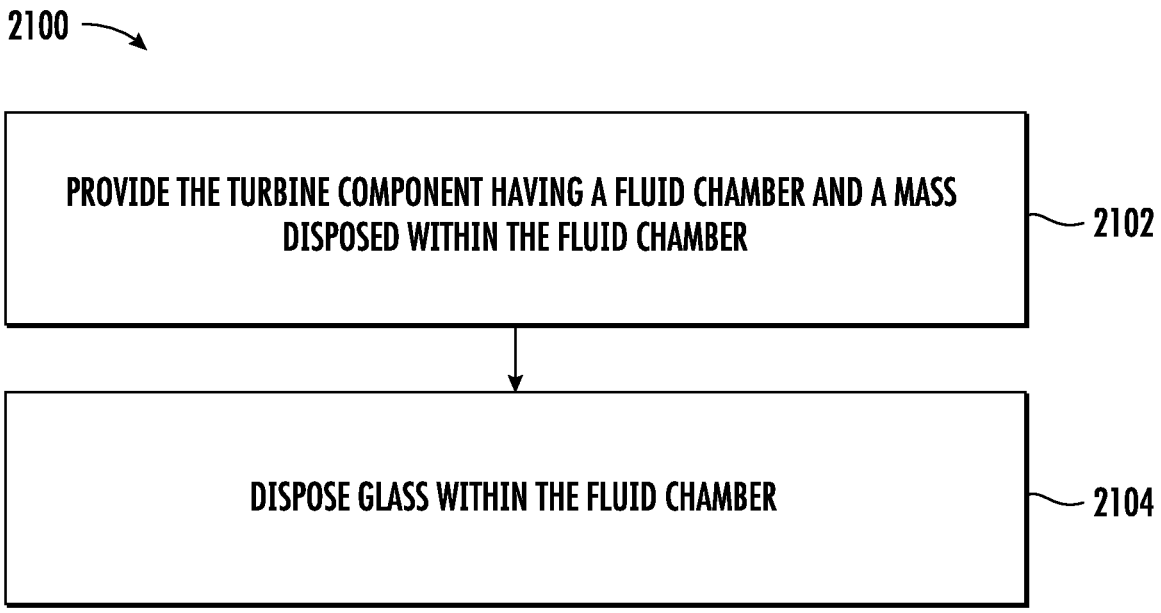
FIG. 21 is a flow chart of a method of operating a turbomachine to adjust an amplitude of oscillations of a turbine component disposed in a turbine section of a turbomachine, in accordance with embodiments of the present disclosure.

Referring now to FIG. 21, a flow diagram of method 2100 of operating a turbomachine having a turbine section 18 with one or more turbine components is provided to adjust an amplitude of oscillations of one or more turbine components disposed in the turbine section 18 of the turbomachine 10. In various embodiments, the one or more turbine components may be any component within the turbine section 18 of the gas turbine 10. In particular embodiments, the turbine component may be a rotor blade 50 disposed in the turbine section 18 and/or a vibrational dampening element 172, 300, 400 disposed the turbine section 18. However, it should be understood that the method 2100 may be utilized with any suitable component of the gas turbine 10 without deviating from the scope of the present disclosure. Additionally, although FIG. 21 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown, in many implementations, the method 2100 may include a step 2102 of providing the turbine component having a fluid chamber and a mass disposed within the fluid chamber. For example, in embodiments in which the turbine component is a rotor blade 50, the fluid chamber may be the fluid chamber 200. Alternatively, or additionally, in embodiments in which the turbomachine component is a vibrational dampening element 300, 400, the fluid chamber may be the fluidic chamber 309, 409.

In many embodiments, as shown, the method 2100 may further include a step 2104 of disposing glass 201 within the fluid chamber. For example, this may be done by injecting molten-state glass into the fluid chamber. Alternatively, or additionally, the fluid chamber may be filled with glass beads that are in a solid state and are subsequently melted during operation of the turbomachine. In many embodiments, the fluid chamber surrounding the mass may be fully filled with glass 201, such that the mass is entirely surrounded by glass. In other embodiments, the fluid chamber may only be partially filled with glass 201, such as 90% filed with glass 201, or such as 60% filled with glass 201, or such as 30% filled with glass 201. In such embodiments, the remainder of the fluid chamber may be filled with air or another viscous fluid, such as liquid gallium.

In exemplary embodiments, operation of the turbine results in a decrease of a viscosity of the glass 201 to produce a molten-state glass (e.g., a glass having a viscosity at or below one or both of the softening point or the working point). Once the glass 201 is in a molten state, the mass may be translated through the molten-state glass to adjust an amplitude of oscillations of the turbomachine component. For example, the viscosity of the glass 201 and the size of the mass may be tuned to alter the dampening properties based on the desired needs at the respective location of the turbomachine component.

In some embodiments, the method 2100 may further include operating the turbomachine such that a temperature of the one or more turbine components increases from a predetermined low temperature range to a predetermined high temperature range. For example, the predetermined low temperature range may be generally room temperature (or the temperature of the ambient environment in which the turbomachine is located), and the predetermined high temperature range may be the temperature of the turbomachine component during operation of the turbomachine.

For example, the turbomachine component may be in the predetermined low temperature range when the turbomachine is shut off or otherwise not in operation. Additionally, or alternatively, the predetermined low temperature range may be between about −50° C. and about 70° C., or such as between about −25° C. and about 50° C., or such as between about −10° C. and about 40° C., or such as between about 0° C. and about 30° C.

Additionally, the turbomachine component may be in the predetermined high temperature range when the turbomachine is in steady-state operating conditions. Specifically, the predetermined high temperature range may be the operating temperature of the turbomachine component (e.g., the material temperature of the rotor blade 50 and/or the vibrational dampening element 300, 400 when the turbomachine is operating). In this way, the predetermined high temperature range may be of between about 600° C. and about 900° C., or such as between about 650° C. and about 850° C., or such as between about 700° C. and about 800° C. In many implementations, because the glass is housed within the turbomachine component, increasing the temperature of the turbomachine component to the predetermined high temperature range also increases the temperature of the glass 201 to the predetermined high temperature range. In exemplary embodiments, the predetermined high temperature range may be higher than one or both of the softening temperature and/or the working temperature of the glass 201. Stated otherwise, the glass 201 may advantageously have a softening temperature lower than the predetermined high temperature range, such that the viscosity of the glass decreases with an increase in the temperature, thereby allowing the mass 202 to move and dampen vibrations of the turbomachine component.

In particular embodiments, the method 2100 may further include decreasing a viscosity of the glass 201 such that the glass 201 shifts from a solid state to a molten state as a result of increasing the temperature of the one or more turbine components to the predetermined high temperature range. Stated otherwise, as a result of increasing the temperature of the one or more turbine components to the predetermined high temperature range, the glass 201 decreases in viscosity and shifts from a solid state to a molten state. The molten state of the glass 201 may be characterized as when the glass 201 is at a temperature that is greater than one or both of the softening temperature and/or the working temperature. Similarly, the solid state of the glass 201 may be characterized as when the glass 201 is at a temperature that is lower than one or both of the softening temperature and/or the working temperature. In many implementations, because the glass 201 is housed within the turbomachine component, increasing the temperature of the turbomachine component to the predetermined high temperature range also increases the temperature of the glass 201 to the predetermined high temperature range. The glass 201 may advantageously have a softening temperature lower than the predetermined high temperature range, such that the viscosity of the glass decreases with an increase in the temperature, thereby allowing the mass 202 to move and dampen vibrations of the turbomachine component.

In many embodiments, the method 2100 may further include adjusting an amplitude of oscillations of the one or more turbine components by moving the mass 202 (e.g., counter-oscillating) within the glass 201 when the glass 201 is in a molten state. This may counteract the oscillations of the turbomachine component, thereby reducing vibrations.

In optional embodiments, the method 2100 may further include operating the turbomachine such that a temperature of the one or more turbine components decreases from the predetermined high temperature range to the predetermined low temperature range. As a result, the glass 201 may increase in viscosity from the molten state to the solid state such that the mass is not movable within the glass 201. For example, in the solid state, the mass 202 may be rigidized within the glass 201 (e.g., rigidly held by the solid-state glass 201), such as during turndown (shutoff) of the turbomachine, start-up of the turbomachine, or non-operation of the turbomachine.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A rotor blade for a turbomachine, the rotor blade comprising: a platform; a shank extending radially inward from the platform; and an airfoil extending radially outward from the platform, wherein one or more fluid chambers are defined within the rotor blade; glass disposed within each fluid chamber of the one or more fluid chambers; and a mass disposed within each fluid chamber of the one or more fluid chambers, the mass movable within the glass relative to the airfoil.

The rotor blade as in one or more of these clauses, wherein the airfoil includes a leading edge, a trailing edge, a pressure side wall extending between the leading edge and the trailing edge, and a suction side wall extending between the leading edge and the trailing edge, wherein the one or more fluid chambers is defined collectively by the leading edge, the trailing edge, the pressure side wall, and the suction side wall.

The rotor blade as in one or more of these clauses, wherein the mass includes a first portion extending between the leading edge and the trailing edge and a second portion extending generally perpendicularly to the first portion.

The rotor blade as in one or more of these clauses, wherein a first pair of guides extend from the pressure side wall and a second pair of guides extend from the suction side wall, and wherein the second portion is disposed between the first pair of guides and the second pair of guides.

The rotor blade as in one or more of these clauses, wherein the airfoil extends from a root coupled to the platform to a tip, and wherein the mass is attached at the root of the airfoil.

The rotor blade as in one or more of these clauses, wherein the airfoil defines a radial channel, and wherein separating walls extend within the radial channel and at least partially define the one or more fluid chambers.

The rotor blade as in one or more of these clauses, wherein the glass includes a viscosity of between about $10^{-4}$ pascal seconds (Pa-s) and about $10^{-2}$ Pa-s at a temperature of between about 600° C. and about 900° C.

The rotor blade as in one or more of these clauses, wherein the glass has a viscosity that changes with a temperature of the glass generally in accordance with one of FIG. 11 or FIG. 12.

A vibrational dampening element attached to a turbine component and configured to adjust an amplitude of oscillations of the turbine component, the vibrational dampening element comprising: a mass; a casing encapsulating the mass; and a fluidic chamber defined between the mass and the casing and filled with glass.

The vibrational dampening element as in one or more of these clauses, wherein the glass has a softening temperature of between about 100° C. to about 900° C.

The vibrational dampening element as in one or more of these clauses, wherein the glass includes a viscosity of between about $10^{-4}$ pascal seconds (Pa-s) and about $10^{-2}$ Pa-s at a temperature of between about 600° C. and about 900° C.

The vibrational dampening element as in one or more of these clauses, wherein the glass is a chalcogenide glass.

The vibrational dampening element as in one or more of these clauses, wherein the glass has a viscosity that changes with a temperature of the glass generally in accordance with one of FIG. 11 or FIG. 12.

A method of adjusting an amplitude of oscillations of a turbine component disposed in a turbine section of a turbomachine, the method comprising: providing the turbine component having a fluid chamber and a mass disposed within the fluid chamber; and disposing glass within the fluid chamber; wherein operation of the turbine results in a decrease of a viscosity of the glass to produce a molten-state glass, the mass being translated through the molten-state glass to adjust the amplitude of oscillations of the turbomachine component.

The method as in one or more of these clauses, wherein the turbomachine component is a rotor blade.

The method as in one or more of these clauses, wherein the turbomachine component is a vibrational dampening element.

The method as in one or more of these clauses, wherein the glass has a softening temperature of between about 100° C. to about 900° C.

The method as in one or more of these clauses, wherein the glass includes a viscosity of between about $10^{-4}$ pascal seconds (Pa-s) and about $10^{-2}$ Pa-s at a temperature of between about 600° C. and about 900° C.

The method as in one or more of these clauses, wherein the glass possesses shear thinning characteristics such that as an acceleration of the mass increases a resistive shear force of the molten-state glass decreases.

The method as in one or more of these clauses, wherein the glass has a viscosity that changes with a temperature of the glass generally in accordance with one of FIG. 11 or FIG. 12.

What is claimed is:

1. A rotor blade for a turbomachine, the rotor blade comprising:

a platform;

a shank extending radially inward from the platform; and an airfoil extending radially outward from the platform, wherein one or more fluid chambers are defined within the rotor blade;

glass disposed within each fluid chamber of the one or more fluid chambers; and a mass disposed within each fluid chamber of the one or more fluid chambers, the mass movable within the glass relative to the airfoil, wherein the glass includes a viscosity of between $10^{-4}$ pascal seconds (Pa-s) and $10^{-2}$ Pa-s at a temperature of between 600° C. and 900° C.

2. The rotor blade as in claim 1, wherein the airfoil includes a leading edge, a trailing edge, a pressure side wall extending between the leading edge and the trailing edge, and a suction side wall extending between the leading edge and the trailing edge, wherein the one or more fluid chambers is defined collectively by the leading edge, the trailing edge, the pressure side wall, and the suction side wall.

3. The rotor blade as in claim 2, wherein the mass includes a first portion extending between the leading edge and the trailing edge and a second portion extending generally perpendicularly to the first portion.

4. The rotor blade as in claim 3, wherein a first pair of guides extend from the pressure side wall and a second pair of guides extend from the suction side wall, and wherein the second portion is disposed between the first pair of guides and the second pair of guides.

5. The rotor blade as in claim 3, wherein the airfoil extends from a root coupled to the platform to a tip, and wherein the mass is attached at the root of the airfoil.

6. The rotor blade as in claim 2, wherein the airfoil defines a radial channel, and wherein separating walls extend within the radial channel and at least partially define the one or more fluid chambers.

7. The rotor blade as in claim 1, wherein the glass has a viscosity that changes with a temperature of the glass in accordance with one of FIG. 11 or FIG. 12.

8. A vibrational dampening element attached to a turbine component and configured to adjust an amplitude of oscillations of the turbine component, the vibrational dampening element comprising:

a mass;

a casing encapsulating the mass; and a fluidic chamber defined between the mass and the casing and filled with glass, wherein the glass includes a viscosity of between $10^{-4}$ pascal seconds (Pa-s) and $10^{-2}$ Pa-s at a temperature of between 600° C. and 900° C.

9. The vibrational dampening element as in claim 8, wherein the glass has a softening temperature of between 100° C. to 900° C.

10. The vibrational dampening element as in claim 8, wherein the glass is a chalcogenide glass.

11. The vibrational dampening element as in claim 8, wherein the glass has a viscosity that changes with a temperature of the glass in accordance with one of FIG. 11 or FIG. 12.

12. A method of adjusting an amplitude of oscillations of a turbine component disposed in a turbine section of a turbomachine, the method comprising:

providing the turbine component having a fluid chamber and a mass disposed within the fluid chamber; and disposing glass within the fluid chamber;

wherein operation of the turbine results in a decrease of a viscosity of the glass to produce a molten-state glass, the mass being translated through the molten-state glass to adjust the amplitude of oscillations of the turbomachine component.

13. The method as in claim 12, wherein the turbomachine component is a rotor blade.

14. The method as in claim 12, wherein the turbomachine component is a vibrational dampening element.

15. The method as in claim 12, wherein the glass has a softening temperature of between 100° C. to 900° C.

16. The method as in claim 12, wherein the glass includes a viscosity of between $10^{-4}$ pascal seconds (Pa-s) and $10^{-2}$ Pa-s at a temperature of between 600° C. and 900° C.

17. The method as in claim 12, wherein the glass possesses shear thinning characteristics such that as an acceleration of the mass increases a resistive shear force of the molten-state glass decreases.

18. The method as in claim 12, wherein the glass has a viscosity that changes with a temperature of the glass in accordance with one of FIG. 11 or FIG. 12.

* * * * *